United States Patent [19]

Umezawa et al.

[11] 4,381,807

[45] May 3, 1983

[54] SHUTTLELESS LOOM WEFT DETAINING DEVICE

[75] Inventors: Hidetugu Umezawa, Higashiyamato; Miyuki Gotoh, Machida; Shigenori Tanaka, Hachioji; Masashi Nakao, Tokyo, all of Japan

[73] Assignee: Nissan Motor Co., Ltd., Yokohama, Japan

[21] Appl. No.: 176,180

[22] Filed: Aug. 7, 1980

[30] Foreign Application Priority Data

Aug. 10, 1979 [JP] Japan ..... 54-101174

[51] Int. Cl.[3] ..... D03D 47/36

[52] U.S. Cl. ..... 139/452; 242/47.01

[58] Field of Search ..... 139/336, 450, 452; 242/47.01, 82, 83

[56] References Cited

U.S. PATENT DOCUMENTS

| | | | |
|---|---|---|---|
| 3,375,216 | 4/1971 | Strauss | 139/452 |
| 3,670,976 | 6/1972 | Vischiani . | |
| 3,674,057 | 7/1972 | Hosono et al. | 139/452 |
| 4,238,080 | 12/1980 | Van Mullekom | 139/452 X |

FOREIGN PATENT DOCUMENTS

| | | | |
|---|---|---|---|
| 122007 | 8/1966 | Czechoslovakia . | |
| 123403 | 12/1966 | Czechoslovakia | 139/452 |
| 141864 | 1/1971 | Czechoslovakia . | |
| 151289 | 2/1973 | Czechoslovakia . | |
| 195503 | 4/1974 | Czechoslovakia . | |
| 197189 | 5/1978 | Czechoslovakia . | |
| 1262847 | 11/1970 | Fed. Rep. of Germany . | |
| 1929485 | 12/1970 | Fed. Rep. of Germany . | |
| 1760738 | 10/1975 | Fed. Rep. of Germany . | |
| 2821725 | 8/1979 | Fed. Rep. of Germany . | |
| 78930 | 1/1971 | German Democratic Rep. . | |
| 51-34499 | 9/1976 | Japan . | |
| 51-176180 | 9/1976 | Japan . | |
| 445404 | 2/1968 | Switzerland . | |
| 462062 | 10/1968 | Switzerland . | |
| 1042868 | 9/1966 | United Kingdom . | |
| 467960 | 4/1975 | U.S.S.R. . | |

*Primary Examiner*—Henry Jaudon

*Attorney, Agent, or Firm*—Thompson, Birch, Gauthier & Samuels

[57] ABSTRACT

A shuttleless loom weft detaining device including a drum rotatable in synchronism with the operational cycle of the loom, the drum being formed with a frustoconical section and a cylindrical section, a first weft yarn catching member disposed between the frustoconical and cylindrical sections to catch a first portion of a weft yarn to detain the weft yarn on the drum for the period of weft picking, and a second weft yarn catching member associated with the cylindrical section of the drum to catch a second portion of the weft yarn to detain the weft yarn on the drum for the period other than the weft picking period, thereby effectively preventing shortpicks of the weft yarn into the shed of warp yarns.

19 Claims, 50 Drawing Figures

SHUTTLELESS LOOM WEFT DETAINING DEVICE

BACKGROUND OF THE INVENTION

This invention relates to a weft detaining device for detaining a predetermined length of a weft yarn from weft yarn supply means, prior to weft picking by weft inserting means.

In connection with a shuttleless loom, a spun yarn which is relatively small in tensile strength has come into use particularly in air jet type shuttleless looms. Accordingly, it is desirable to control the weft yarn tension, since a slight variation in tension can break the weft yarn. Conventional devices detain the weft yarn in lengths of about ⅔ of that required for each weft picking. The weft yarn tension abruptly increases when the yarn is changed from its free flight period, in which the detained weft yarn is picked, to the measuring flight period in which the weft picking continues measuring the length of the weft yarn. Therefore, it is necessary to detain the weft yarn in a length of one weft pick in order to draw the weft yarn from the detaining device with little resistance. This is achieved by a device disclosed in Japanese Patent Publication No. 51-34499. In this device, a ring having an annular brush is disposed around an end section at the weft inserting nozzle side of a drum having a conical section and a cylindrical section. This drum functions to wind the weft yarn thereon in lengths of one weft picking. The length of detained weft yarn is maintained constant by optically sensing the amount on the drum and rotating the drum accordingly. In this device, the annular brush serves as a stop for the weft yarn at the end section at the weft inserting nozzle side, and functions to prevent the weft yarn wound on the drum from coming off.

With such a device, since more weft yarn than that required for one weft picking remains on the drum, the weft picking is accomplished with the weft yarn which is completely detained on the drum and therefore an abrupt variation in weft yarn tension does not occur during weft picking. However, the weft yarn always receives resistance to its movement since it is drawn from the drum contacting the annular brush. This results in the following disadvantages, particularly in a shuttleless loom whose weft picking is accomplished by a relatively weak dragging force, for example in the air jet type shuttleless loom: (1) weft yarn shortpicks may occur in the warp yarn shed; (2) higher air pressure is required to overcome the weft yarn dragging force; and (3) the detaining device will not separate the weft yarn in the amount required for one weft picking and accordingly requires a device for restricting the length of the weft yarn to be picked.

BRIEF SUMMARY OF THE INVENTION

In accordance with the present invention, a shuttleless loom weft detaining device is provided with a drum having a frustoconical section and a cylindrical section, the device being rotatable in synchronism with the loom. The weft detaining device also includes a first weft catching means associated with the surface of the drum for catching a first portion of the weft yarn to detain the weft yarn on the drum for the weft picking period, and second weft catching means associated with the surface of the cylindrical section of the drum for catching a second portion of the weft yarn to detain the weft yarn on the drum for the remainder of the weft picking period, thereby winding a predetermined length of weft yarn on the cylindrical section prior to picking. With this arrangement, weft yarn shortpicks in the warp yarn shed are effectively prevented, without an increase in pressurized air volume. Additionally, a separate device for restricting the weft yarn length required for one weft picking is unnecessary.

BRIEF DESCRIPTION OF THE DRAWINGS

The features and advantages of the weft detaining device according to the present invention will be more clearly appreciated from the following description taken in conjunction with the accompanying drawings in which like reference numerals designate corresponding parts and elements, and in which:

FIGS. 5A to 9A are right-side views of the essential part of the device of FIG. 1, illustrating the operation of the device;

FIGS. 5B to 9B are respective plan views taken in the directions of arrows A of FIGS. 5A to 9A, illustrating the operation of the device of FIG. 1;

FIGS. 12A to 16A are right-side views of the essential part of the device of FIG. 10;

FIGS. 12B to 16B are respective plan views taken from the directions of arrows A of FIGS. 12A to 16A;

DETAILED DESCRIPTION OF THE EMBODIMENTS OF THE INVENTION

Figure 1:
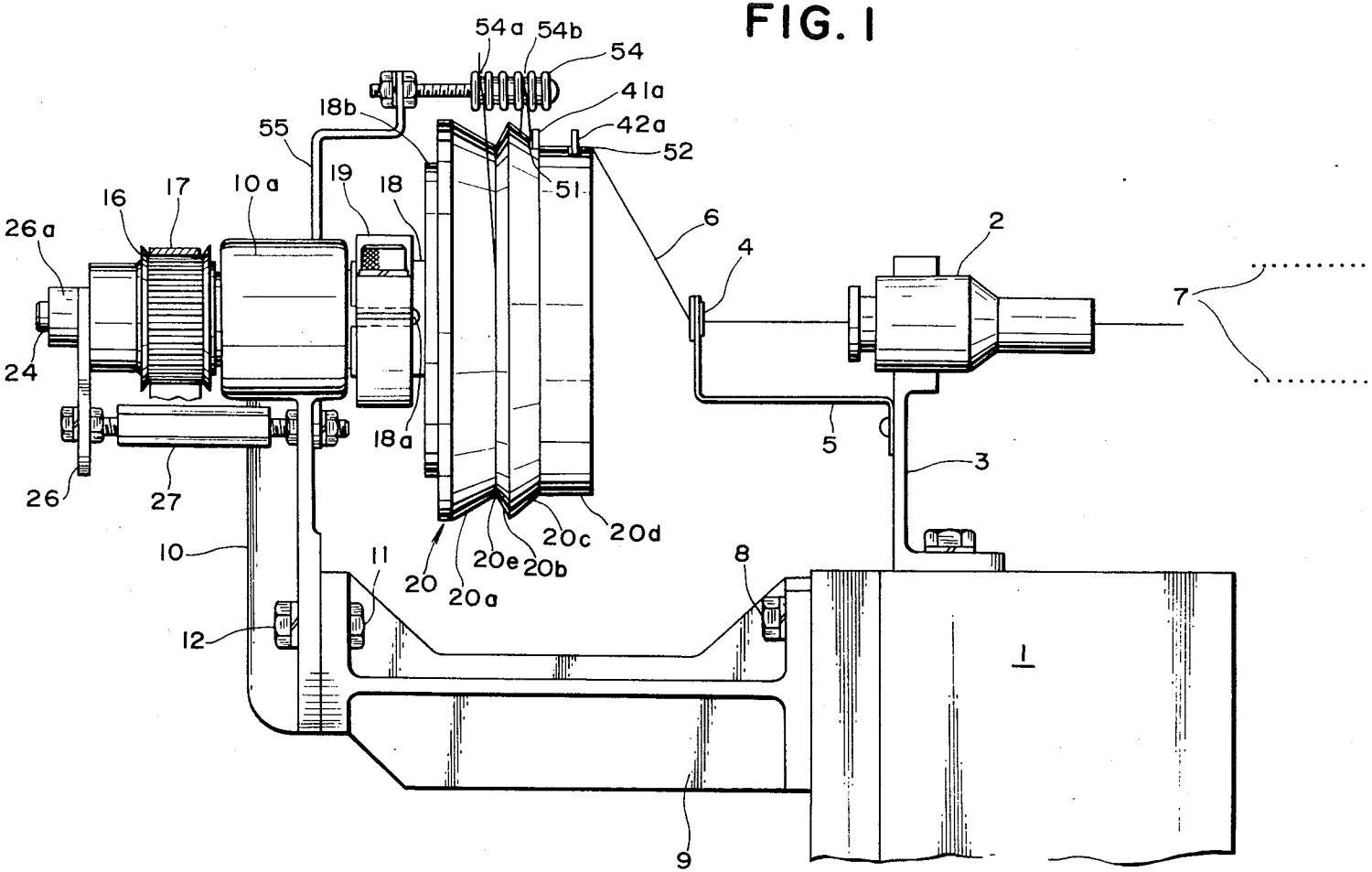
FIG. 1 is an elevational view of a first embodiment of a shuttleless loom weft detaining device in accordance with the present invention.

Referring now to FIG. 1, there is shown a first embodiment of a shuttleless loom weft detaining device in accordance with the present invention. A weft inserting air injection nozzle 2 is supported by a nozzle holder 3 which is fixed on the frame 1 of the shuttleless loom. A guide 4 is supported by a stay 5 which is secured to the nozzle holder 3, and located rearward of the nozzle 2 so that the axis thereof is in alignment with that of the nozzle 2. With this arrangement, a weft yarn 6 from the weft detaining device discussed hereinafter is introduced into the nozzle 2 through the guide 4, and then is picked or inserted into the warp yarn shed by means of air injected from the nozzle.

A bracket 10 having a bearing section 10*a* is secured to the frame 1 of the shuttleless loom through a horizontally disposed bracket 9 which is directly secured to the frame of the loom by bolts 8, as shown in FIG. 1. The bracket 10 is connected at its bottom part to the bracket 9 with bolts 11 and nuts 12 so that the axis of the bearing section 10*a* is in alignment with that of the guide 4.

Figure 3:
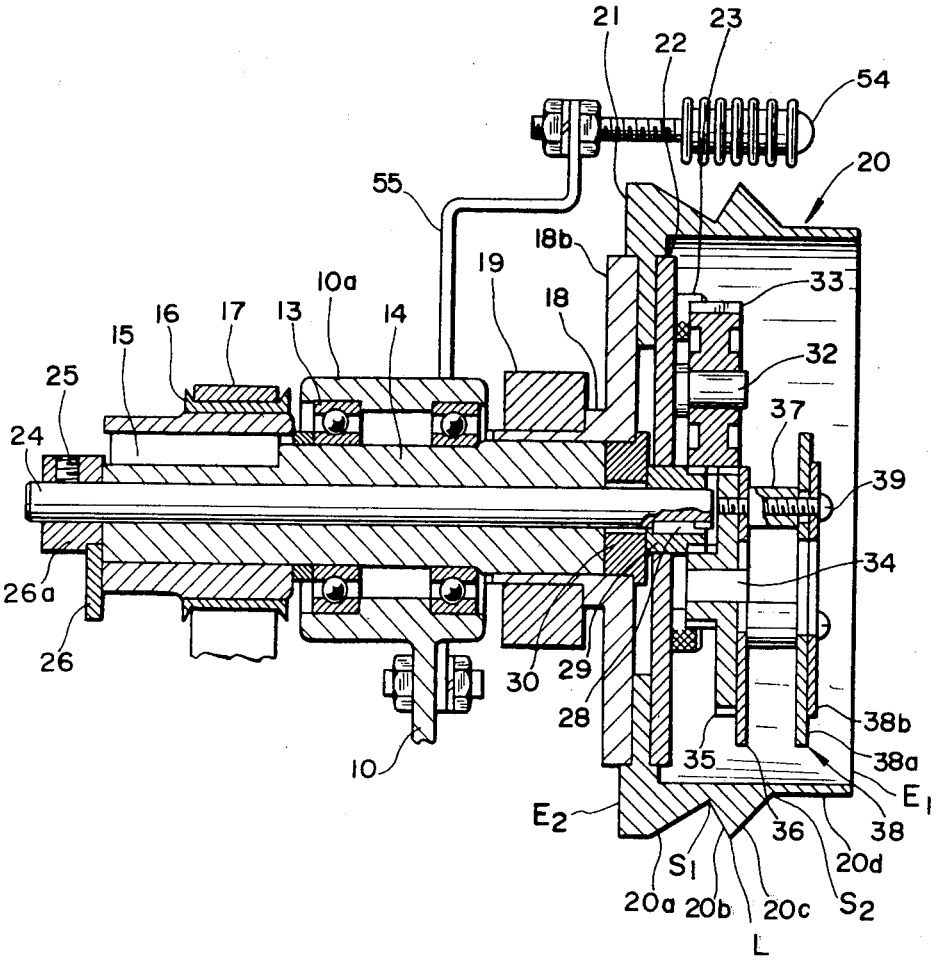
FIG. 3 is a vertical sectional view of the essential part of the device of FIG. 1.
Figure 4:
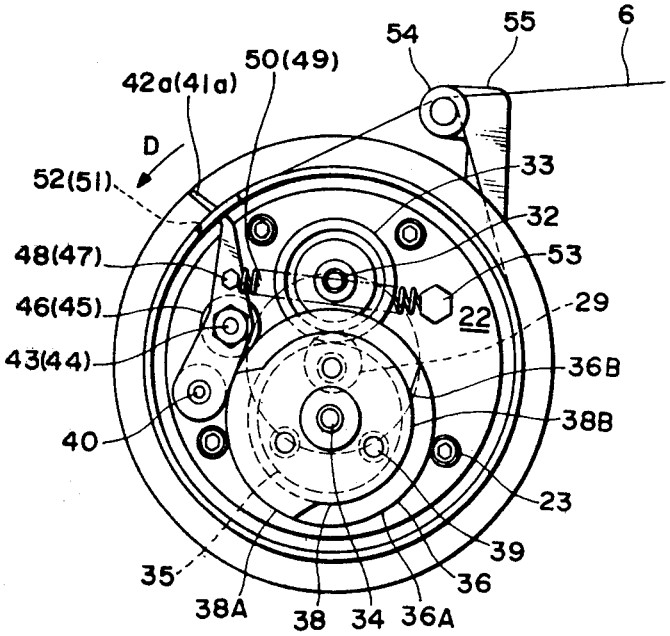
FIG. 4 is a right-side view of the essential part of the device of FIG. 1.

As shown in FIG. 3, a hollow shaft 14 is rotatably supported at its central section in the bearing section 10*a* by a ball bearing 13. A toothed pulley 16 is fixedly mounted on a rear section of the hollow shaft 14 by means of a key 15. A toothed belt 17 connects the pulley 16 and a drive pulley (not shown) to rotate the hollow shaft 14 with the loom. The following illustrates the case where the transmission ratio is 3:1, i.e., where the hollow shaft 14 rotates three times per each operational cycle of the loom.

A support ring 18 having a slit 18*a* (shown in FIG. 1) is mounted on a front portion of the hollow shaft 14, and is fixed thereto by a lock 19. A drum 20 for measuring and detaining the weft yarn is fixed on a flange 18*b* of the support ring 18 in such a manner that a flange 21 of the drum 20 is positioned between the front surface of the flange 18*b* and a base plate 22, and fixed thereto as a single member by bolts 23. The drum 20 is provided at its peripheral surface with a first frustoconical section 20*a*, tapered from the rear end section $E_2$ to the front end section $E_1$ of the drum. The frustoconical section 20*a* terminates at a first small diameter section $S_1$. A second frustroconical section 20*b* continues from the first small diameter section $S_1$, tapering in the reverse direction to that of the first frustoconical section 20*a*, and terminates at a large diameter section L. A third frustroconical section 20*c* continues from the large diameter section L, tapering in the same direction as the first frustoconical section 20*a*, and terminates at a second small diameter section $S_2$, smaller than the first diameter section $S_1$. A cylindrical section 20*d* continues from the second small diameter section $S_2$ and extends to the front end section $E_1$ of the drum 20. The cylindrical section 20*d* has a diameter smaller than that of $S_1$. In this instance, the diameter of the cylindrical section 20*d* is set so that the length of the weft yarn wound three times on the cylindrical section corresponds to the length required for each weft picking.

A shaft 24 disposed in the hollow shaft 14 is fixed relative to the loom, but is rotatable within the hollow shaft. The rear end section of the shaft 24 is provided with a boss section 26*a* of a lever 26, secured to the shaft by a small screw 25. As shown in FIG. 1, the end of the lever 26 is fixedly connected to the bracket 10 by a stud 27 so that the shaft 24 is fixed and not rotatable. The front end section of the fixed shaft 24 is positioned in the central portion of the base plate 22. A gear 29 is fixedly mounted on the front section of the fixed shaft 24 by a key 28. A spacer 30 maintains a space between the hollow shaft 14 and the gear 29.

The gear 29 engages a gear 33 which is rotatably mounted on a shaft 32 mounted on the base plate 22. The gear 33 engages a gear 35 which is rotatably mounted on a shaft 34. In this instance, the reduction gear ratio of the gear 29 to the gear 35 is 1:3; therefore the gear 35 makes $\frac{1}{3}$ of a revolution per each revolution of the the drum 20, revolving around the gear 29. Accordingly, the gear 35 revolves once per one operational cycle of the loom.

Also with reference to FIG. 3, the gear 35 includes at its side surface a cam 36 mounted thereto by a stud 37. A cam 38, formed by superposing a cam plate 38*b* on another cam plate 38*a*, is fixed on the stud 37 by a small screw 39. The cam 36 is formed with a high lobe section 36A and a low lobe section 36B. The profile of cam 38 is controlled by varying the locational relationship between the cam plates 38*a* and 38*b* to obtain desirable high and low lobe sections 38A and 38B.

Figure 2:
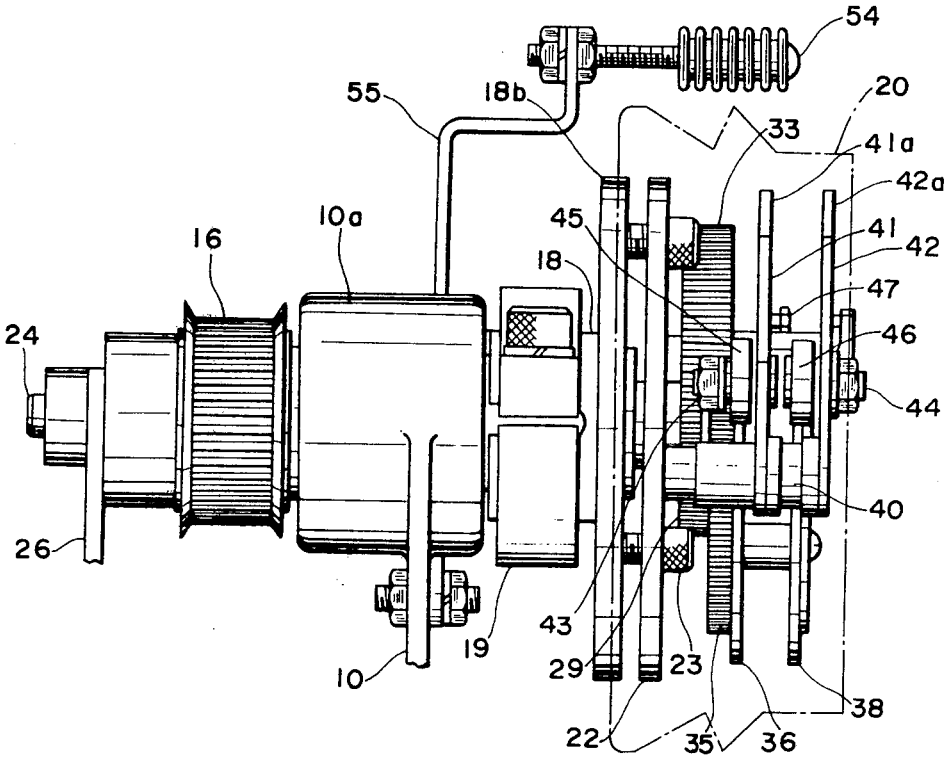
FIG. 2 is an elevational view of an essential part of the device of FIG. 1, the drum being omitted.

First and second hook levers 41, 42 (in FIG. 2) of the same shape are rotatably mounted at their end sections on a fixed shaft 40 which is mounted on the base plate 22. Cam rollers 45 and 46 are rotatably mounted on pins 43 and 44 which are mounted at the central sections of the first and second hook levers 41 and 42, respectively. Bolts 47 and 48 are fixed on the first and second hook levers 41 and 42, respectively. Springs 49 and 50 are disposed between the bolts 47, 48 and a bolt 53 which is fixed on the base plate 22, so that the first and second hook levers 41, 42 are biased to urge the cam rollers 45, 46 to contact the cams 36 and 38, respectively. The first and second hook levers 41 and 42 are formed with respective hook sections 41*a* and 42*a*, located to face respective holes 51 and 52, formed side by side in the vicinity of the drum second small diameter section $S_2$ and the cylindrical section 20*d*, respectively. The hook sections 41*a* and 42*a* of the first and second hook levers 41 and 42 are constructed and arranged to project through the holes 51 and 52 out of the drum 20 when the cam high lobe sections 36A and 38A contact respective cam rollers 45 and 46, and to be withdrawn into the drum 20 when the cam low lobe sections 36B and 38B contact the cam rollers.

A rod like guide 54 is fixed on the tip end of a stay 55 which is fixed to the bracket 10. The guide 54 is formed with at least two grooves 54*a* and 54*b*, and is positioned so that the axis thereof is parallel to that of the drum 20. The weft yarn 6 drawn from a yarn supply means such as a cone-shaped bobbin engages the groove 54*a* and then passes on to a groove 20*e* formed at the drum first small diameter section between the first and second frustoconical sections, 20*a* and 20*b*. Subsequently, the weft yarn engages the guide groove 54*b* and passes on to the third frustroconical section 20*c* and on to the cylindrical section 20*d*, and thereafter is caught by one of the hook sections 41*a* and 42*a* and is passed through the guide 4.

The manner of operation of the above-described first embodiment will be illustrated hereinafter with reference to FIGS. 1 to 9B. When the hollow shaft 14 is rotated by the rotational force transmitted to the pulley through the belt 17, the drum 20 rotates in the direction of arrow D (counterclockwise in the right-side views) three times per one operational cycle of the loom. The weft yarn 6 is wound on the drum groove 20*e* through the first frustoconical section 20*a* after passing through the guide groove 54*a*, and further engages the third frustoconical section 20*c* through the guide groove 54*b*. At this time, the weft yarn 6 slides down the surface of the third frustoconical section 20*c* under its own tension, and along the cylindrical section 20*d*, pushing the weft yarn wrapped thereon toward the drum front end section $E_1$.

Figure 5A:
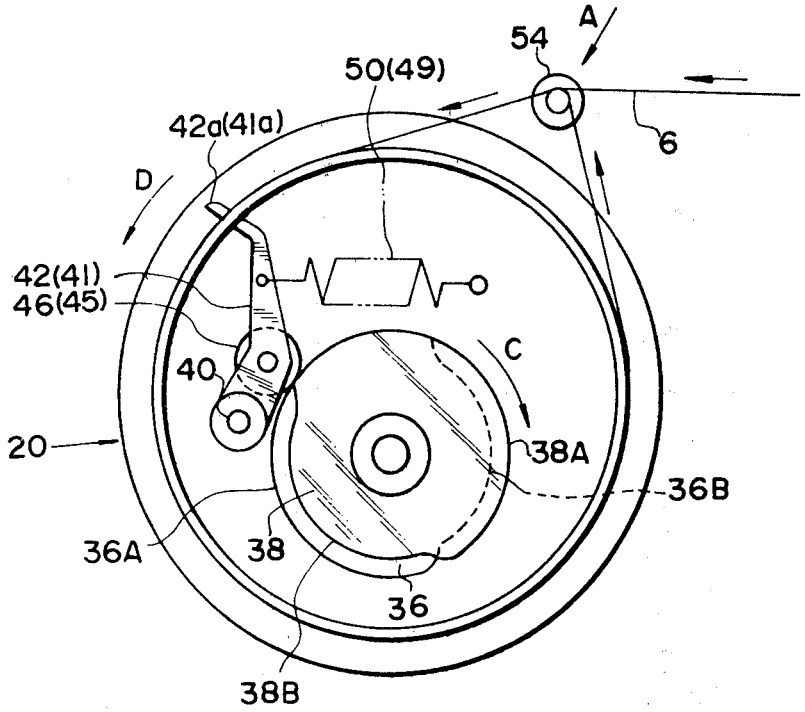
Figure 5B:
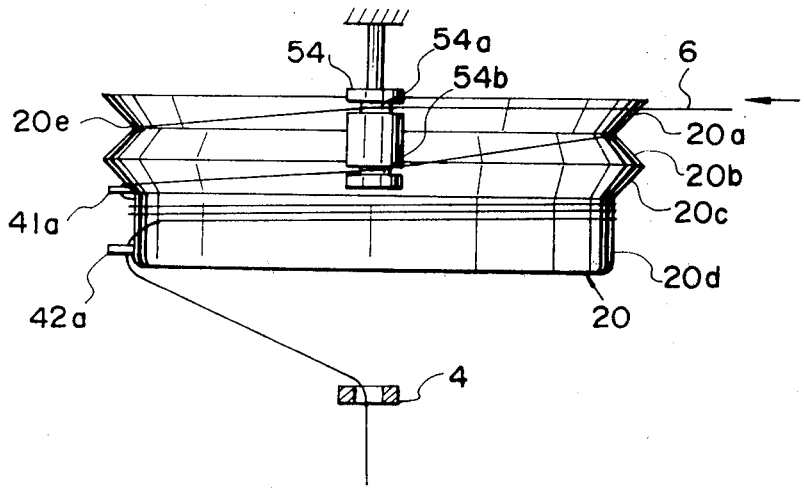

Now, the explanation will be made setting a time immediately before a weft picking as the starting point. At this time, the cam high lobe sections 36A and 38A contact respective cam rollers 45 and 46, as shown in FIG. 5A, and consequently the hook lever sections 41*a* and 42*a* project out of the drum 20 through respective holes 51 and 52. Only a slight amount of weft yarn is wound on the third frustoconical section 20*c* between the guide groove 54*a* and the hook section 41*a*. The weft yarn 6 is wound three times on the cylindrical section 20*d* between the hook sections 41*a* and 42*a*, is caught on the hook section 42*a* and is introduced into the guide 4. This length of weft yarn 6 is that prepared for one weft picking by being measured and detained.

Figure 6A:
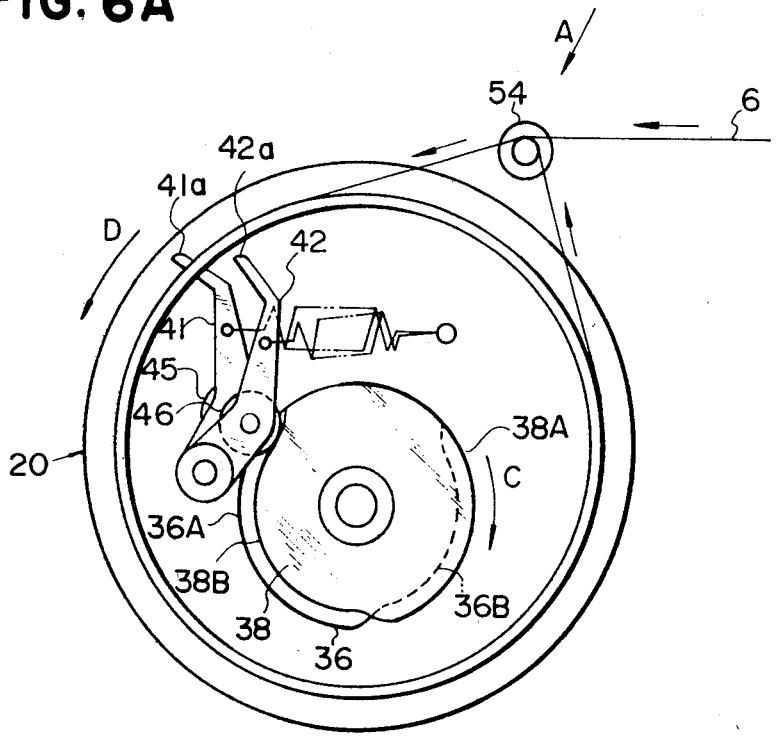
Figure 6B:
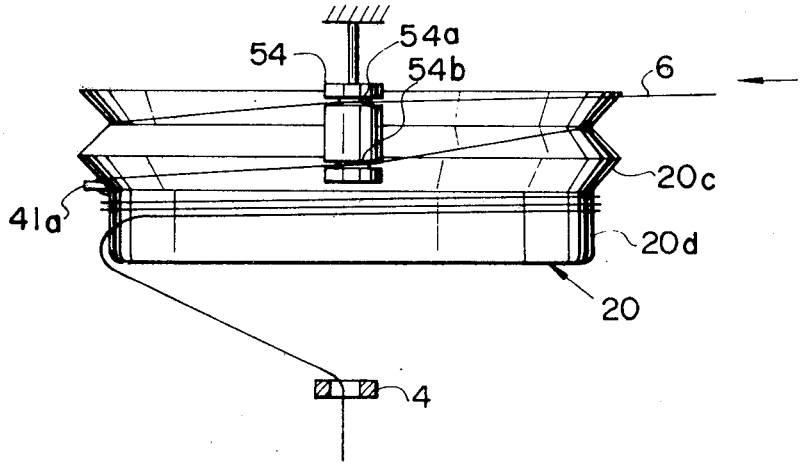
Figure 7A:
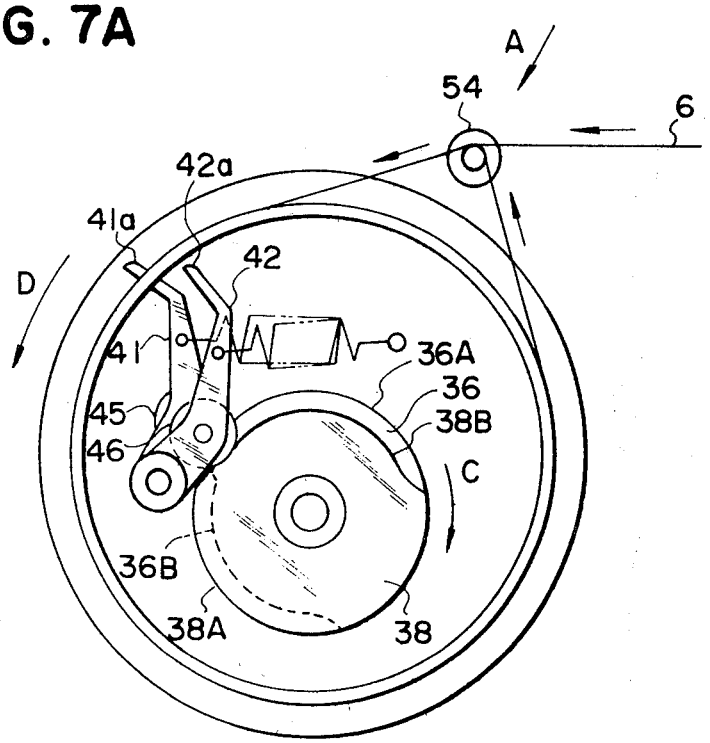
Figure 7B:
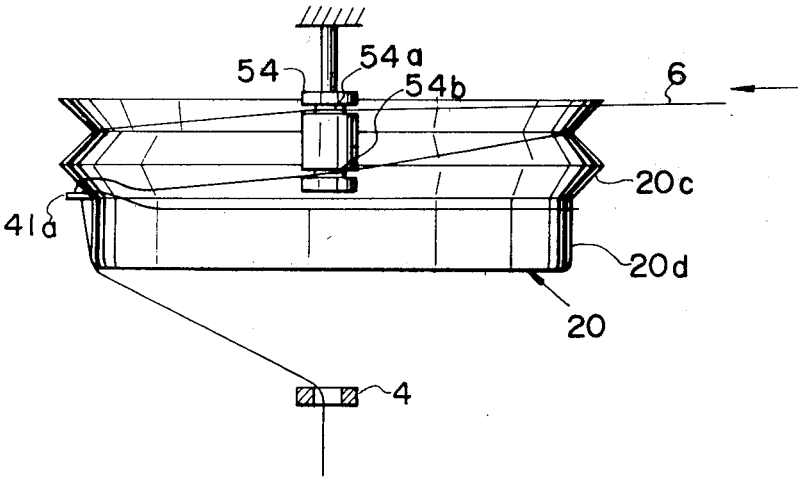

From this state, when the drum 20 rotates in the direction of the arrow D, the cams 36 and 38 rotate together in the direction of the arrow C one time per one operational cycle of the loom. Accordingly, the cam roller 45 of the first hook lever 41 continues to contact the cam high lobe section 36A, while the cam roller 46 of the second hook lever 42 is brought into contact with the cam low lobe section 38B, withdrawing the hook lever section 42*a* into the drum 20 as shown in FIGS. 6A and 6B. Air injection from the air injection nozzle 2 begins immediately before this time, so that when the hook lever section 42*a* is withdrawn into the drum 20, the weft yarn wound on the drum cylindrical section 20*d* is released. The weft yarn 6 is drawn by the air stream through the nozzle 2 and then picked into the warp yarn shed 7. After the air injection from the nozzle 2 ceases, weft yarn inertia picks all of the yarn from the drum cylindrical section 20*d*. The weft yarn 6 is caught by the first hook lever section 41*a* and the weft picking is completed as shown in FIGS. 7A and 7B. During this weft picking, since the drum 20 rotates once in the direction of the arrow D, the weft yarn 6 is wound one round on the drum plus the length from the guide groove 54*b* to the hook section 41*a*.

Figure 8A:
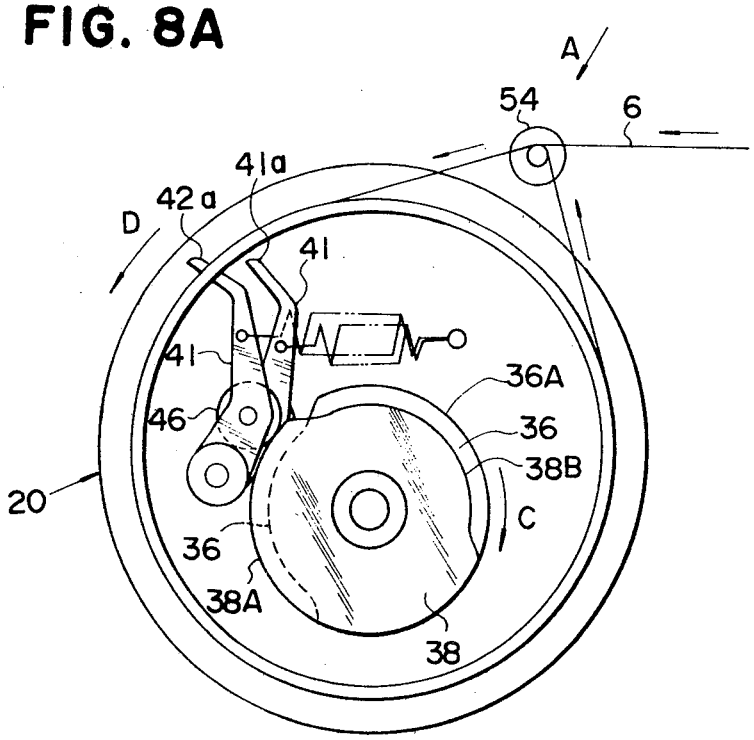
Figure 8B:
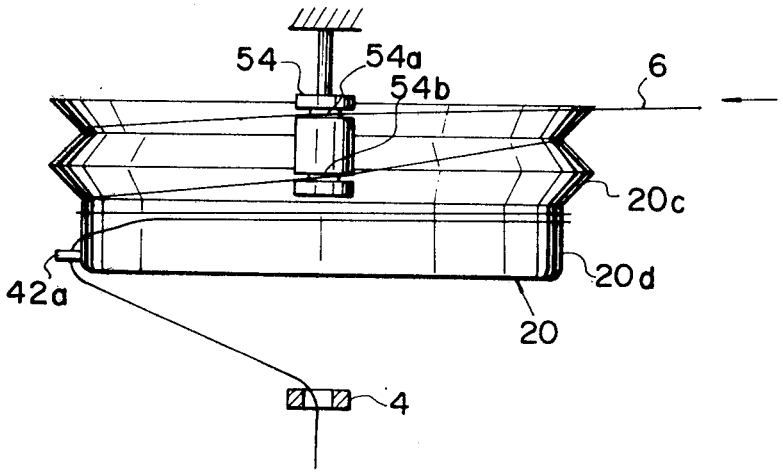

Next, the cam roller 46 contacts the cam high lobe section 38A, causing the hook section 42*a* to project from the drum 20 through the hole 52. Next, the first cam roller 45 contacts the cam low lobe section 36B, withdrawing the hook section 41*a* into the drum 20. Therefore, the weft yarn 6 which has been caught by the hook section 41*a* until this time slides down the third frustoconical section 20*c* to the cylindrical section 20*d*, to be caught by the hook section 42*a*, as shown in FIGS. 8A and 8B.

Figure 9A:
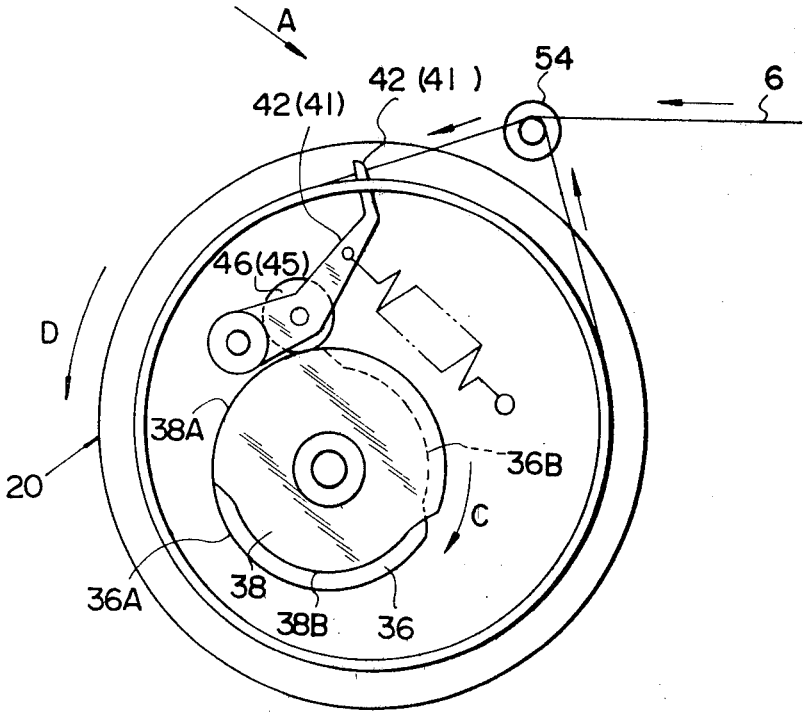
Figure 9B:
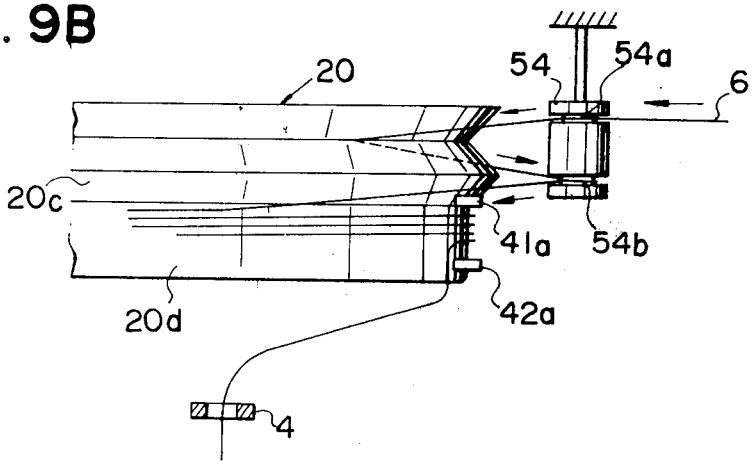

When the weft yarn 6 is wound on the cylindrical section 20*d* three times, the first cam roller 45 contacts the cam high lobe section 36A and the hook section 41*a* projects out of the drum 20. However, at this time, the weft yarn 6 advancing from the guide groove 54*b* toward the third frustoconical section 20*c* has not yet been wound around the drum 20. Additionally, the weft yarn already wound around the drum 20 moves to the cylindrical section 20*d*. Therefore, the hook section 41*a* projects without catching the weft yarn 6 as shown in FIGS. 9A and 9B. The mechanism recycles to the position depicted in FIGS. 5A and 5B, in which the second cam roller 46 contacts the cam low lobe section 38B to withdraw the hook section 42*a*, and the weft picking cycle repeats.

FIGS. 10 to 16B inclusive illustrate a second embodiment of the weft detaining device in accordance with the present invention, which is similar to the first embodiment with the exception that the second hook lever 42 is omitted and replaced with other means.

In this embodiment, the drum cylindrical section 20*d* is formed at its front end section with a small diameter cylindrical section 20*f* which is smaller in diameter than the cylindrical section 20*d*. The small diameter cylindrical section 20*f* is formed with a saw-tooth section having a plurality of teeth 60*a* for catching the weft yarn brought into contact therewith.

The guide 4 is attached to an upper end of a lever 62 which is rotatably mounted at its central section on a shaft 61 attached to the bracket 9. The lever 62 is biased clockwise in FIG. 10 by a spring 65, a pin 63 on the lever 62 and a pin 64 on the bracket 9. The lever 62 is provided at its lower end with a cam roller 67 attached to the lever 62 by a pin 66. The spring 65 urges the cam roller 67 into contact with the cam 38'. This cam 38' is mounted on a shaft 68 rotatably supported by the bracket 9, and rotates once per one operational cycle of the loom, causing the guide 4 to shift along the axis of the drum 20 so that it causes the weft yarn 6 to be caught by the saw-tooth section 60 when the cam roller 67 contacts the cam high lobe section 38'A, and to be released when the cam roller 67 contacts the cam low lobe section 38'B.

The manner of operation of the second embodiment will be illustrated with reference to FIGS. 10 to 16B, inclusive. Immediately before the weft picking, the hook lever cam roller 45 contacts the cam high lobe section 36A, causing the the hook lever section 41*a* to project from of the drum 20 through the hole 51 to catch the weft yarn 6. Simultaneously, the cam roller 67 contacts the cam high lobe section 38'A, causing the guide 4 to move backward toward the drum 20 so that the weft yarn 6 is caught by the saw-tooth section 60. The weft yarn 6 is wound three rounds on the drum cylindrical section 20*d* as shown in FIG. 12.

Figure 13A:
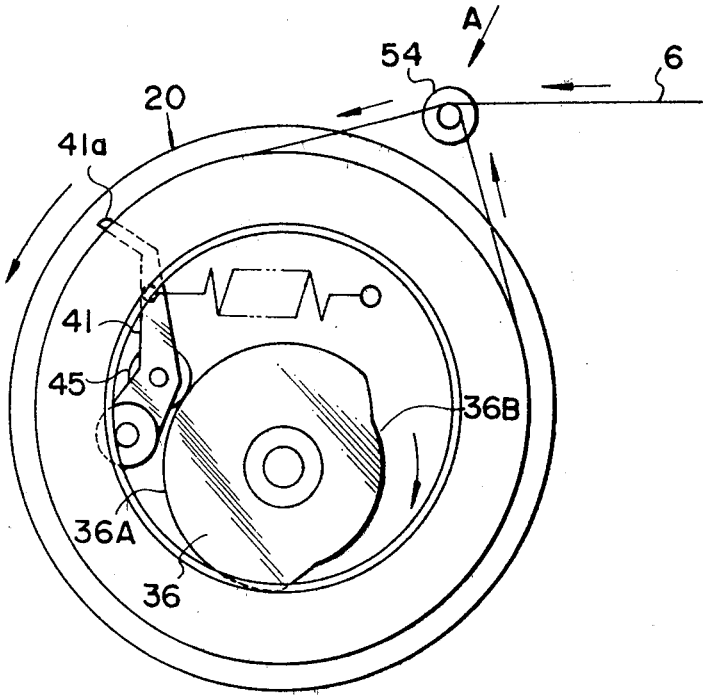
Figure 13B:
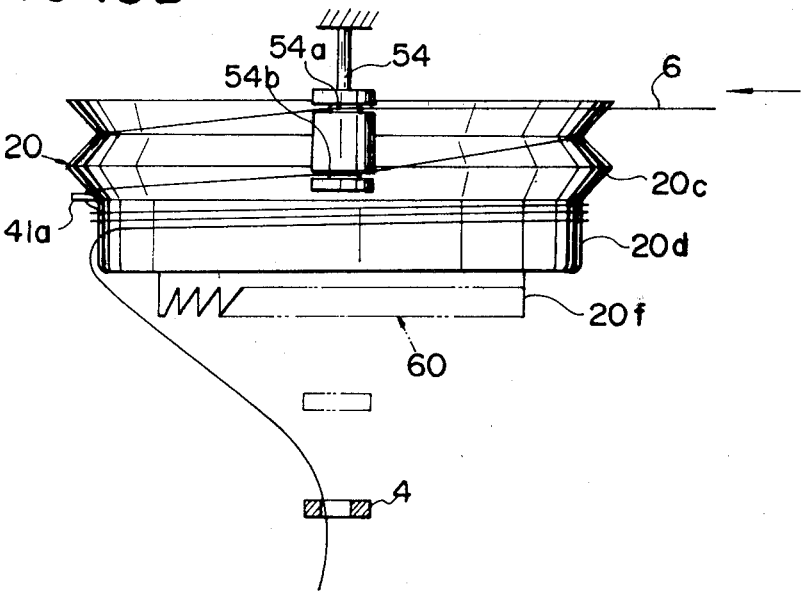
Figure 14A:
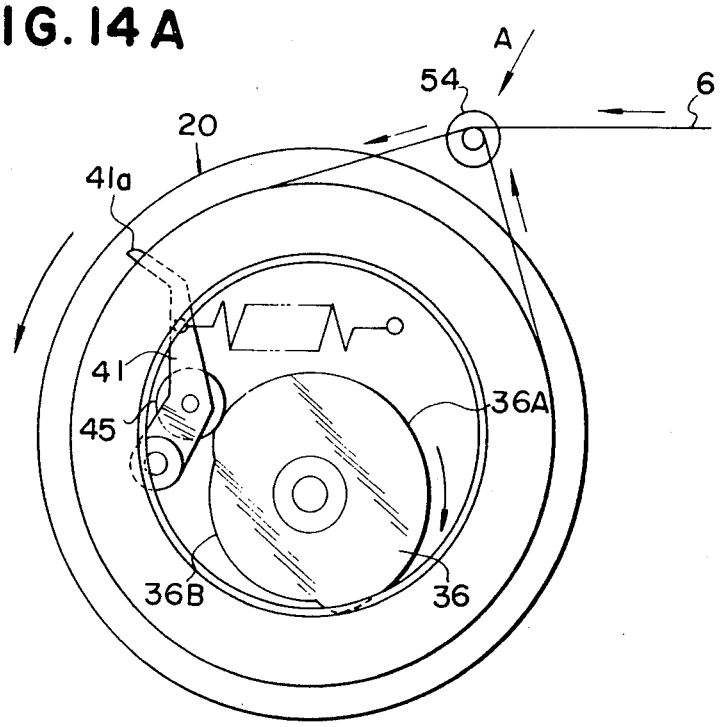
Figure 14B:
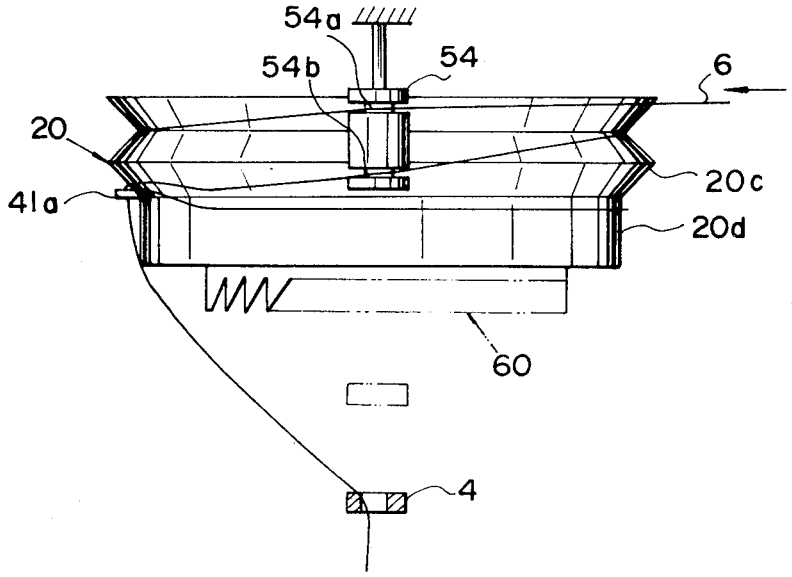

When weft is to be picked, the cam roller 67 contacts the cam low lobe section 38'B, shifting the guide 4 forward (rightward in FIG. 10) to release the weft yarn 6 from the saw-tooth section 60, as shown in FIGS. 13A and 13B. The weft yarn 6 is picked into the warp yarn shed 7 as mentioned above under the action of the air jet of the nozzle 2. When all of the weft yarn 6 wound on the drum cylindrical section 20*d* is picked into the shed and is caught by the hook section 41*a*, the weft picking is completed. One round of weft yarn is kept by the hook section 41*a* as shown in FIGS. 14A and 14B.

Figure 15A:
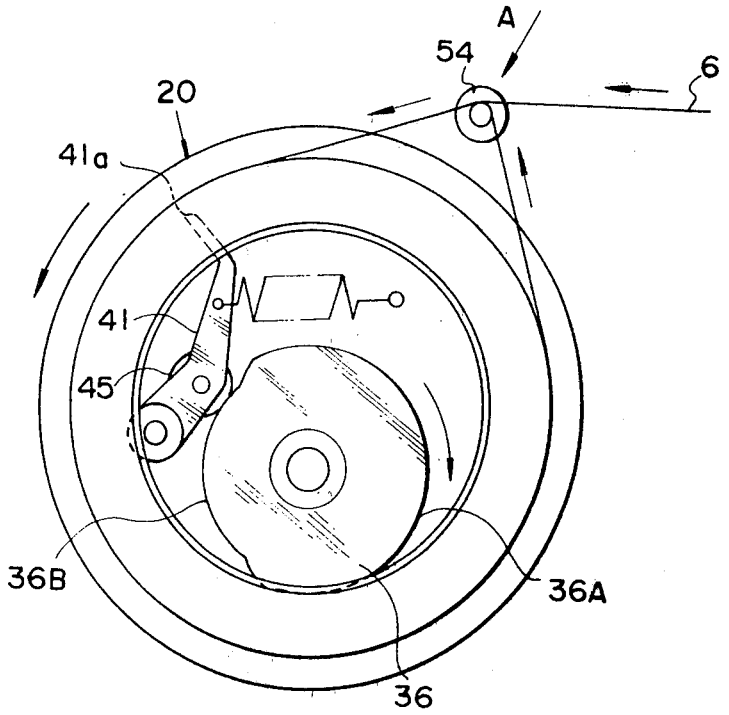
Figure 15B:
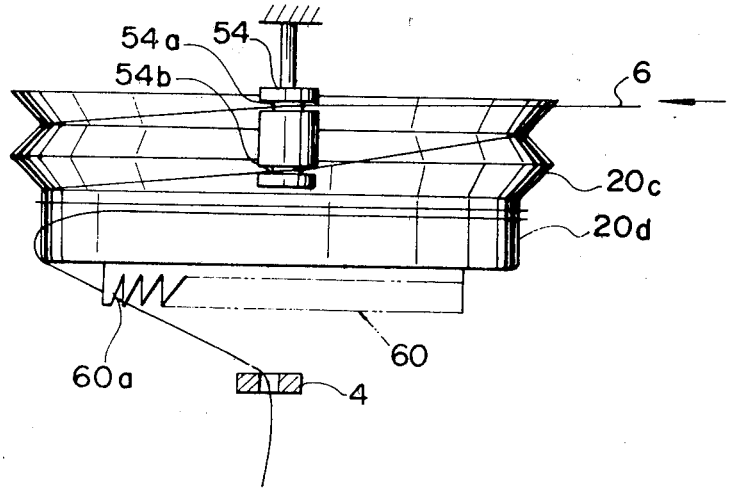
Figure 16A:
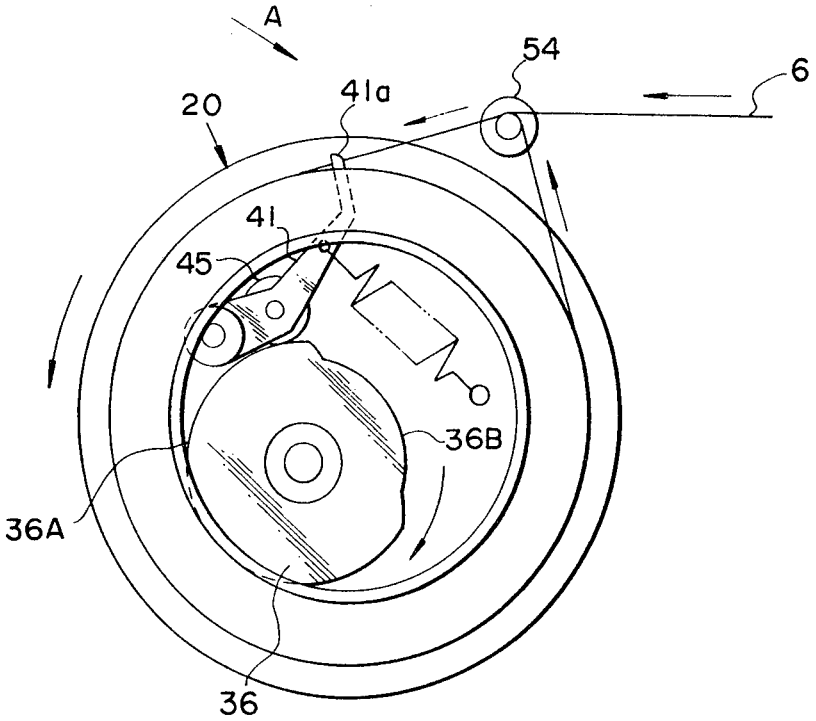
Figure 16B:
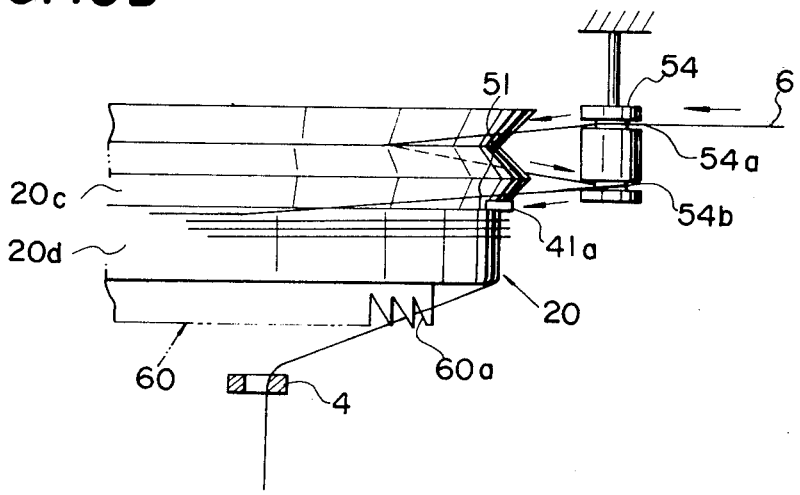
Figure 17:
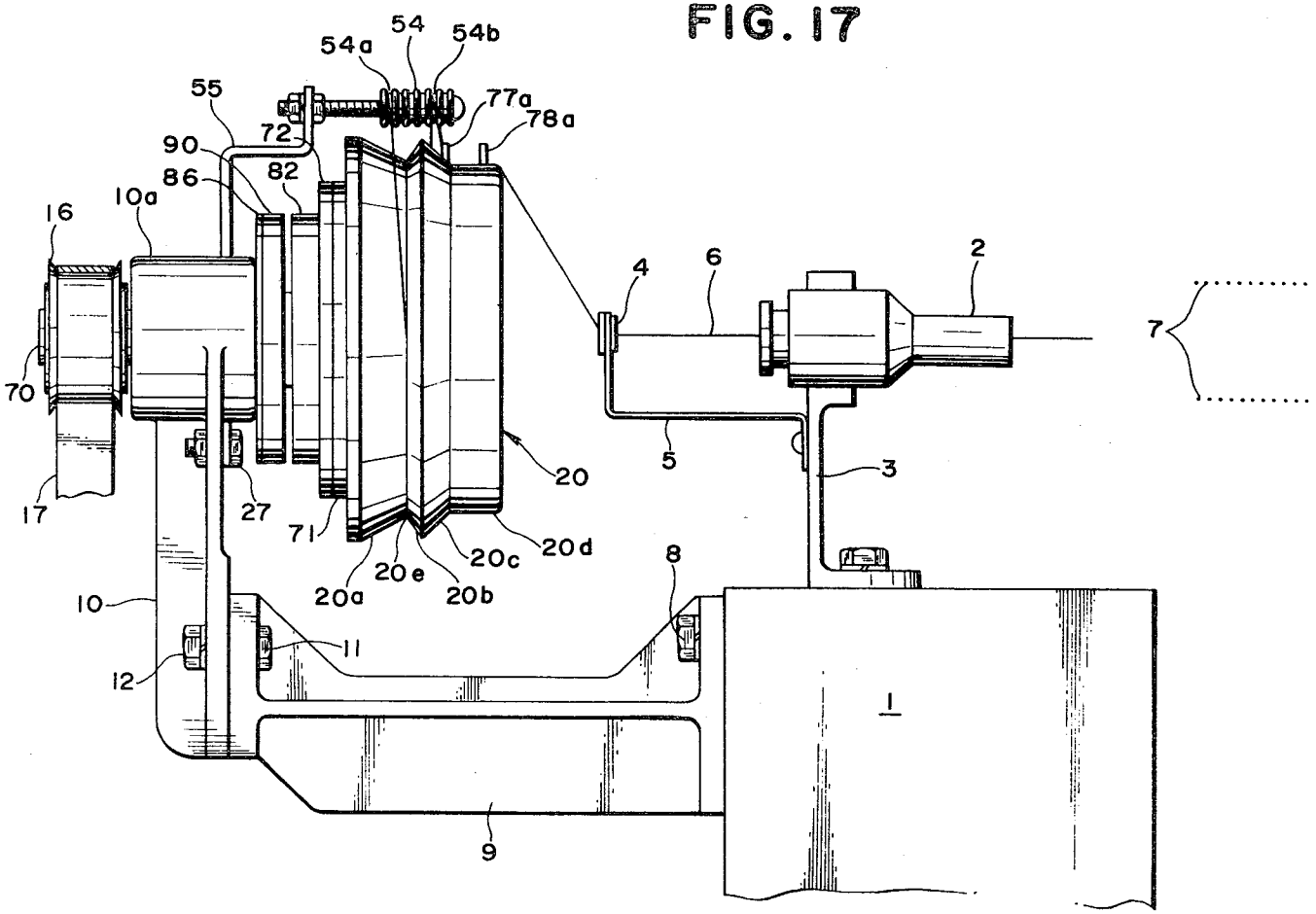
FIG. 17 is an elevational view of a third embodiment of the weft detaining device in accordance with the present invention.
Figure 18:
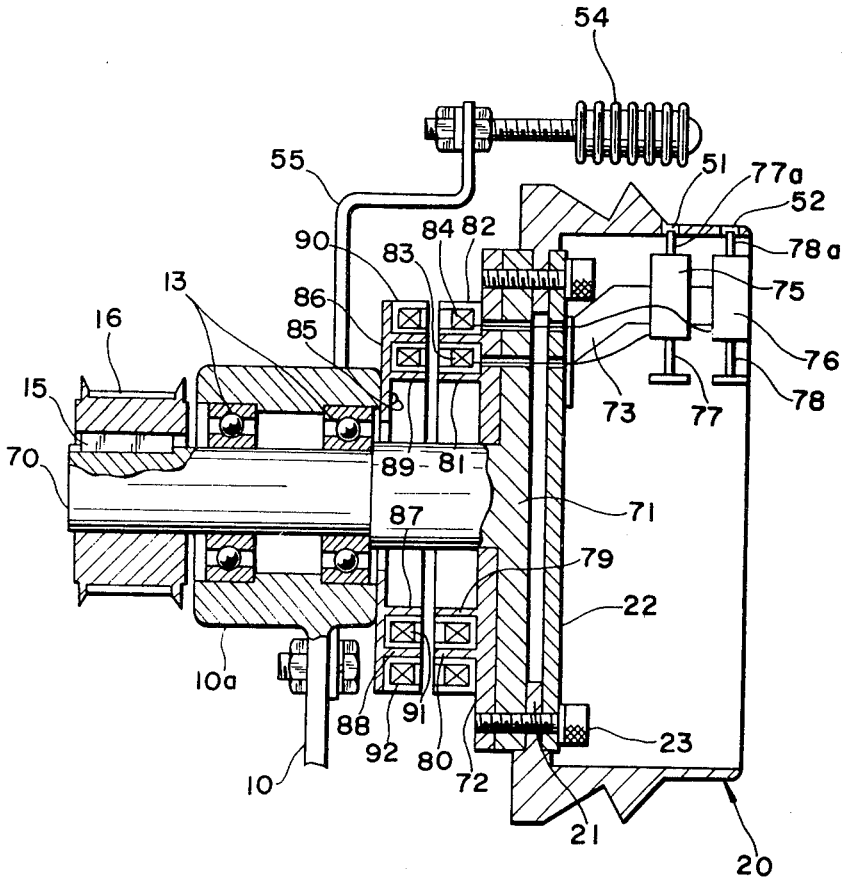
FIG. 18 is a cross-sectional view of the essential part of the device of FIG. 17.
Figure 19:
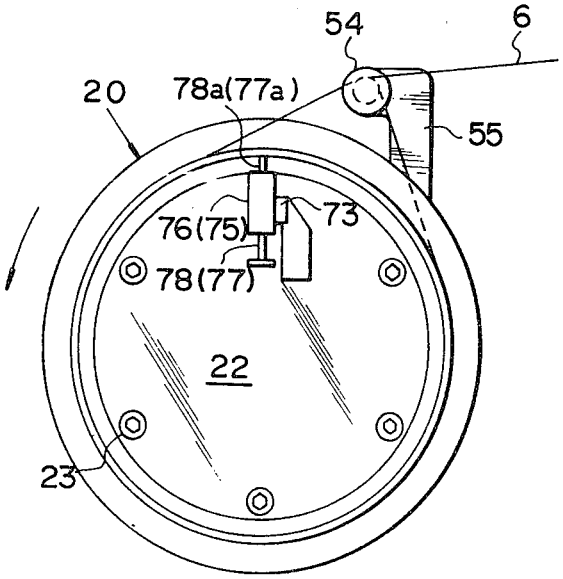
FIG. 19 is a right-side view of the device of FIG. 18.

Next, the lever cam roller 67 contacts the cam high lobe section 38'A and shifts the guide 4 toward the drum 20, so that the weft yarn 6 is caught by the saw-tooth section 60. Thereafter, when the hook lever cam roller 45 contacts the cam low lobe section 36B to retract the hook section 41*a* into the drum 20, the weft yarn 6 slides down the surface of the third frustoconical section to the cylindrical section as shown in FIG. 15. When the weft yarn 6 is wound approximately three rounds on the cylindrical section, the cam roller 45 contacts the cam high lobe section 36A to extend the hook section 41*a* through the drum hole 51 between the weft yarn portion on the third frustoconical section 20*c* and the weft yarn portion wound on the cylindrical section 20*d* as shown in FIG. 16B. Thereafter, the mechanism recycles to the position depicted in FIGS. 12A and 12B, and the cycle is repeated.

FIGS. 17 to 25C illustrate a third embodiment of the weft detaining device according to the present invention. In this embodiment, a rotatable shaft 70 is supported by the ball bearing 13 within the bearing section 10*a* of the bracket 10, and is arranged to rotate by the force transmitted from the pulley 16. The shaft 70 is formed at its front end with a flange 71. The flange 21 of the drum 20 is positioned between the base plate 22 and the flange 71 and is held together by bolts 23 screwed into a non-magnetic circular coil support member 72.

The base plate 22 is provided with a support 73 for supporting two electromagnetic actuators 75 and 76 so positioned that the axes thereof are in the radial direction of the drum 20. The actuators 75 and 76 include movable iron rods 77 and 78, respectively, which are formed at their respective tip sections with hook sections 77*a* and 78*a*, positioned to face respective holes 51 and 52. The electromagnetic actuators 75 and 76 are positioned to extend respective rod hook sections 77*a* and 78*a* from the drum 20 in response to energizing the respective actuators 75 and 76.

The coil support member 72 is formed with cylindrical supports 79 and 80 concentric with the rotatable shaft 70 that project in the direction of the bearing section 10*a*. The cylindrical supports 79 and 80 support respective circular iron cores 81 and 82, attached thereto by an adhesive or the like. Coils 83 and 84 are wound around the respective iron cores 81 and 82 to surround the walls thereof, and are electrically connected to respective electromagnetic actuators 75 and 76.

Another circular coil support member 86 is fixed on the end surface of the bearing section 10*a* by small screws 85. The coil support member 86 includes two cylindrical supports 87 and 88 similar to the coil support member 72. Coils 91 and 92 are wound around iron cores 89 and 90, attached to respective cylindrical supports 87 and 88. The coils 91 and 92 are located to face respective coils 83 and 84, to form a rotary transformer.

Figure 20:
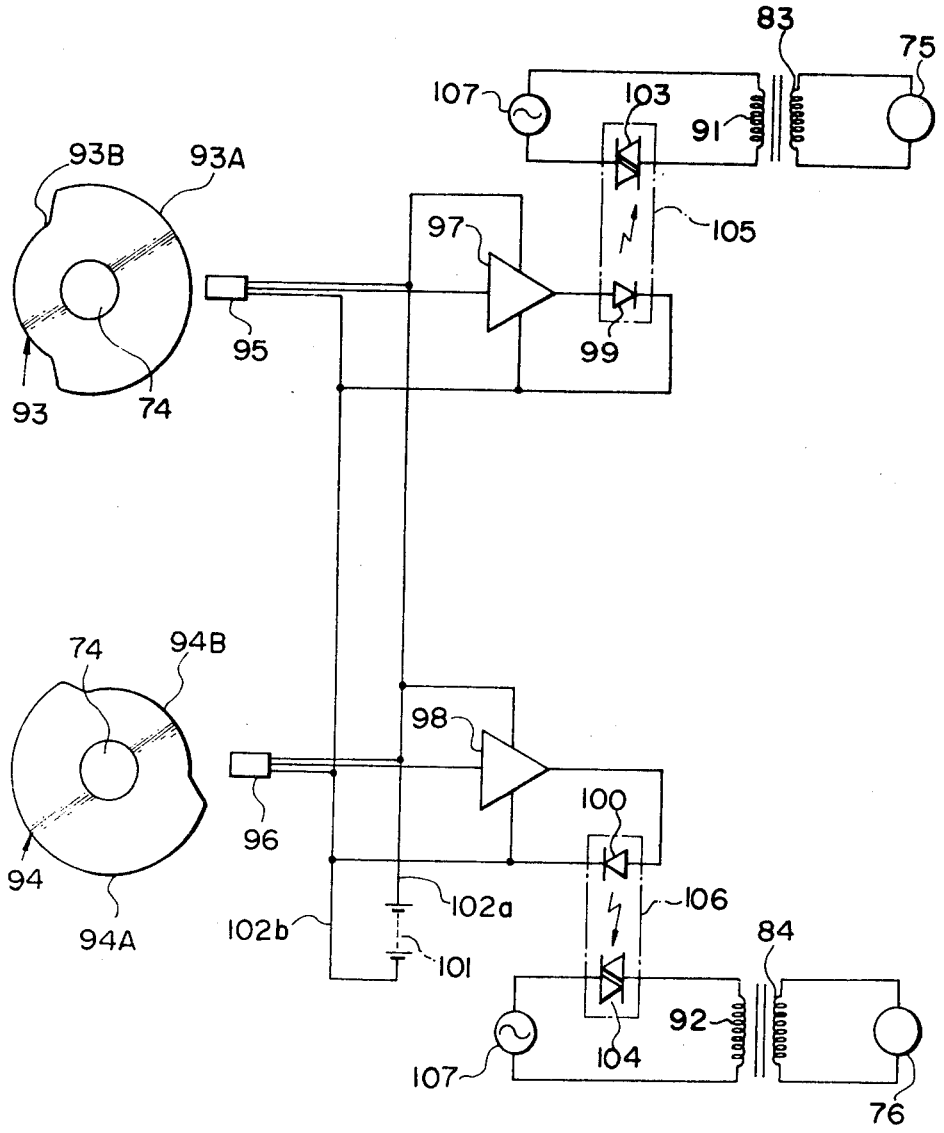
FIG. 20 is a schematic diagram of the device of FIG. 17.

An electric current supply to the coils 91 and 92 will be explained with reference to the circuit diagram of FIG. 20. Cams 93 and 94 are fixedly mounted on a shaft 74 operatively connected to a rotational part of the loom to rotate once per one operational cycle of the loom. The cam 93 is formed with high and low lobe sections 93A and 93B; the cam 94 is formed with high and low lobe sections 94A and 94B. Magnetic switches 95 and 96 are provided to operate with respective cams 93 and 94. The output terminals of the magnetic switches 95 and 96 are electrically connected through amplifiers 97 and 98 to respective light emitting diodes 99 and 100. A direct current power source 101 supplies current to the magnetic switches 95 and 96 and the amplifiers 97 and 98 through bus lines 102*a* and 102*b*. The light emitting diodes 99 and 100 are optically coupled with respective photo-TRIACs 103 and 104, connected in series between respective coils 91, 92 and an alternating current source 107.

During the operation of the third embodiment of the shuttleless loom, the shaft 70 and drum 20 rotate three times per one operational cycle of the loom. This causes relative rotation between the coils 83, 84 and coils 91, 92.

The cams 93 and 94 rotate once per one loom operational cycle. For simplification purposes, only the top half of FIG. 20 will be explained with the understanding that the circuit of the bottom half operates identically. When the magnetic switch 95 faces the cam high lobe section 93A, it generates an output signal which is amplified by the amplifier 94. The amplified output signal is supplied to turn on the light emitting diode 99. The light beam from the light emitting diode 99 turns on the TRIAC 103 to conduct an electric current through the transformer coil 91, energizing the electromagnetic actuator 75, to extend the rod hook section 77*a* through the drum hole 51. When the cam low lobe section 93B faces the magnetic switch 95, no output signal is generated. As a result, the rod hook section 77*a* remains retracted within the drum 20.

Figure 21A:
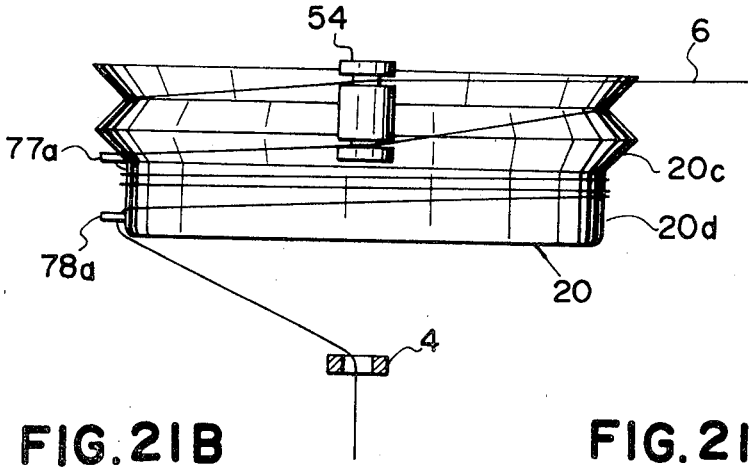
FIGS. 21A to 25C are views illustrating the operation of the device of FIG. 17.
Figure 21B:
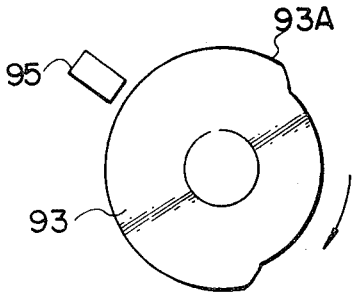
Figure 21C:
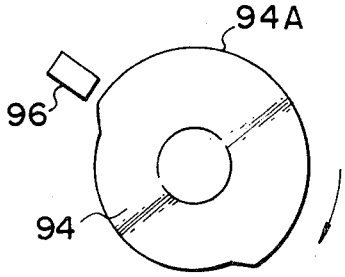
Figure 22A:
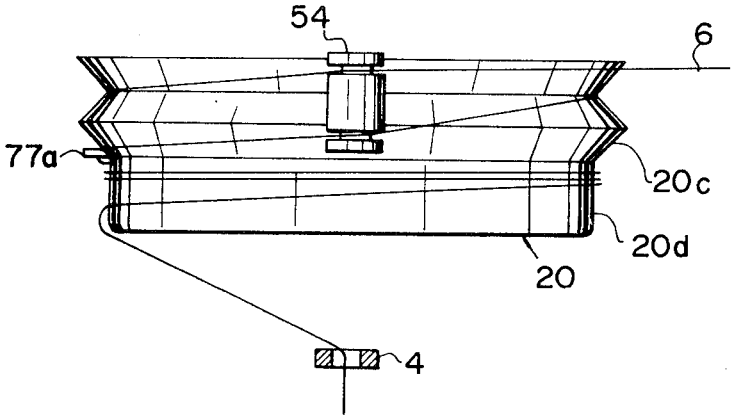
Figure 22B:
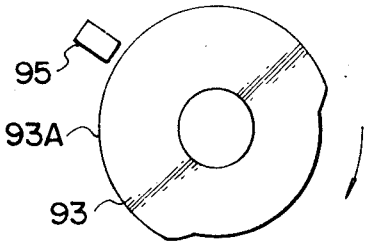
Figure 22C:
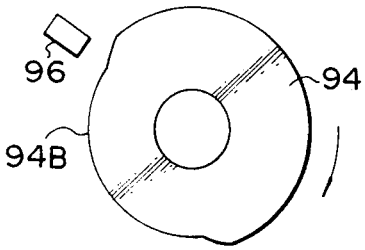
Figure 23A:
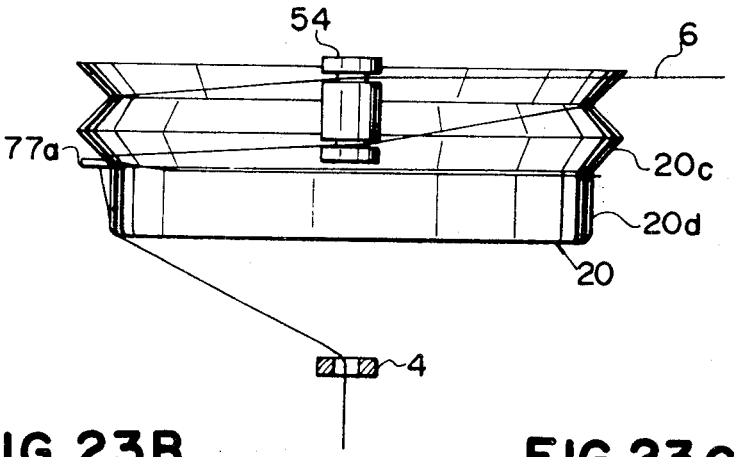
Figure 23B:
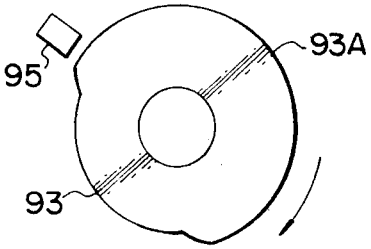
Figure 23C:
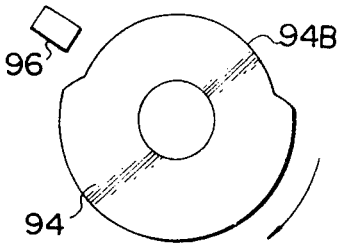

With reference to FIGS. 21A to 25C, immediately before the weft picking, the cam high lobe section 93A faces the magnetic switch 95 and therefore the rod hook section 77*a* extends from the drum 20. Additionally, the cam high lobe section 94A faces the magnetic switch 96, and accordingly the rod hook section 78*a* also extends from the drum 20. In this state, the weft yarn 6 is wound three rounds on the cylindrical section 20*d* after being caught by the hook section 77*a*, and is thereafter caught by the hook section 78*a*, as shown in FIG. 21A. As the loom operational cycle continues, the magnetic switch 95 faces the cam high lobe section 93A, air injection from the nozzle 2 begins and the magnetic switch 96 approaches the cam low lobe section 94B. Immediately after the hook section 78*a* is retracted into the drum 20, that weft yarn on the drum cylindrical section 20*d* is picked through the air injection nozzle 2 to the warp yarn shed. The drum 20 rotates approximately one turn during this weft picking. The extended hook section 77*a* catches the weft yarn 6 during this revolution and wraps approximately one round thereof on the drum, as shown in FIG. 23A.

Figure 24A:
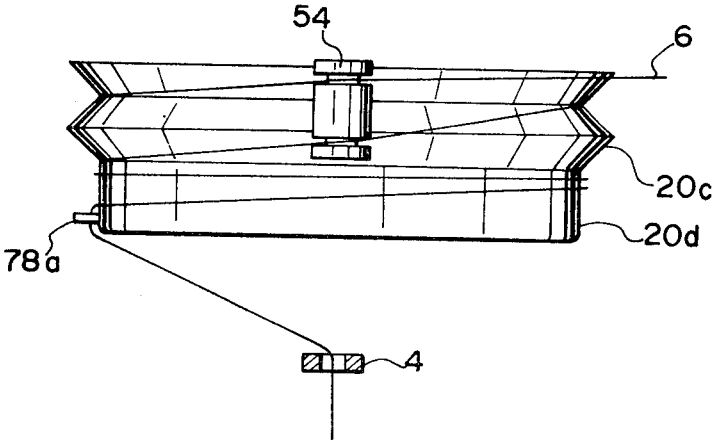
Figure 24B:
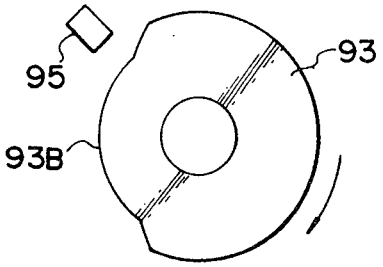
Figure 24C:
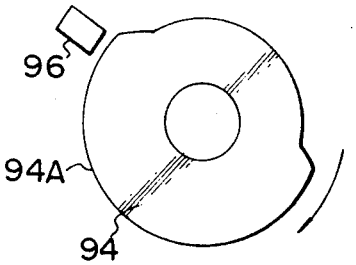

Next, the magnetic switch 96 faces the cam high lobe section 94A, causing the hook section to extend from the drum 20. Subsequently, the magnetic switch 95 faces the cam low lobe section 93B, withdrawing the hook section 77*a* into the drum 20. As a result, the weft yarn 6 wound on the third frustoconical section 20*c* slides down onto the cylindrical section 20*d* to be caught by the hook section 78*a*, as shown in FIG. 24A.

Figure 25A:
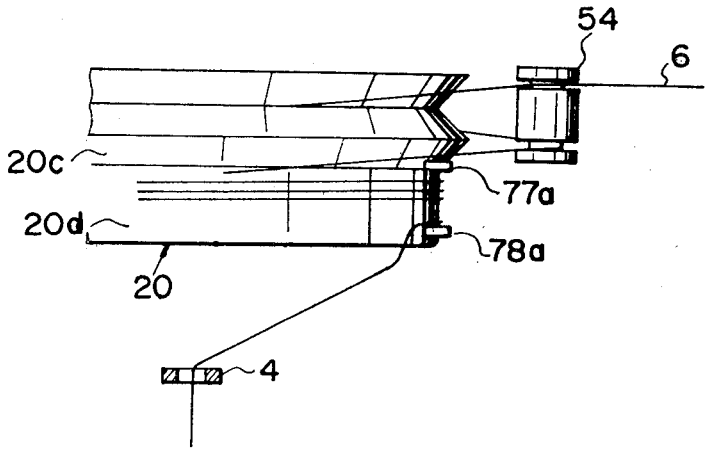
Figure 25B:
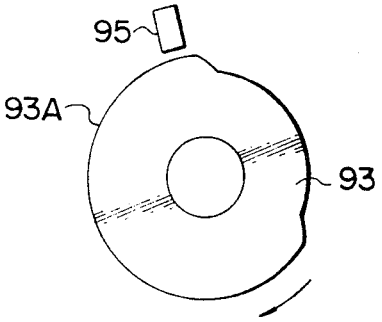
Figure 25C:
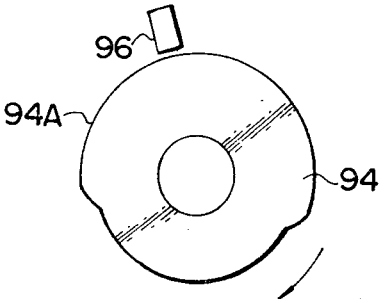

When the weft yarn 6 is wound approximately three times on the cylindrical section 20*d*, the magnetic switch 95 faces the cam high lobe section 93A, causing the hook section 77*a* to project between the weft yarn portion which is being wound on the third frustoconical section 20*c* and the weft yarn portion on the cylindrical section 20*d*, as shown in FIG. 25A. Subsequently, the weft picking is carried out as described hereinabove.

This third embodiment provides an advantage in that the length of the weft yarn required for one weft picking can be easily changed as desired by changing the cams 93 and 94 without changing the gears used in the loom.

Figure 26:
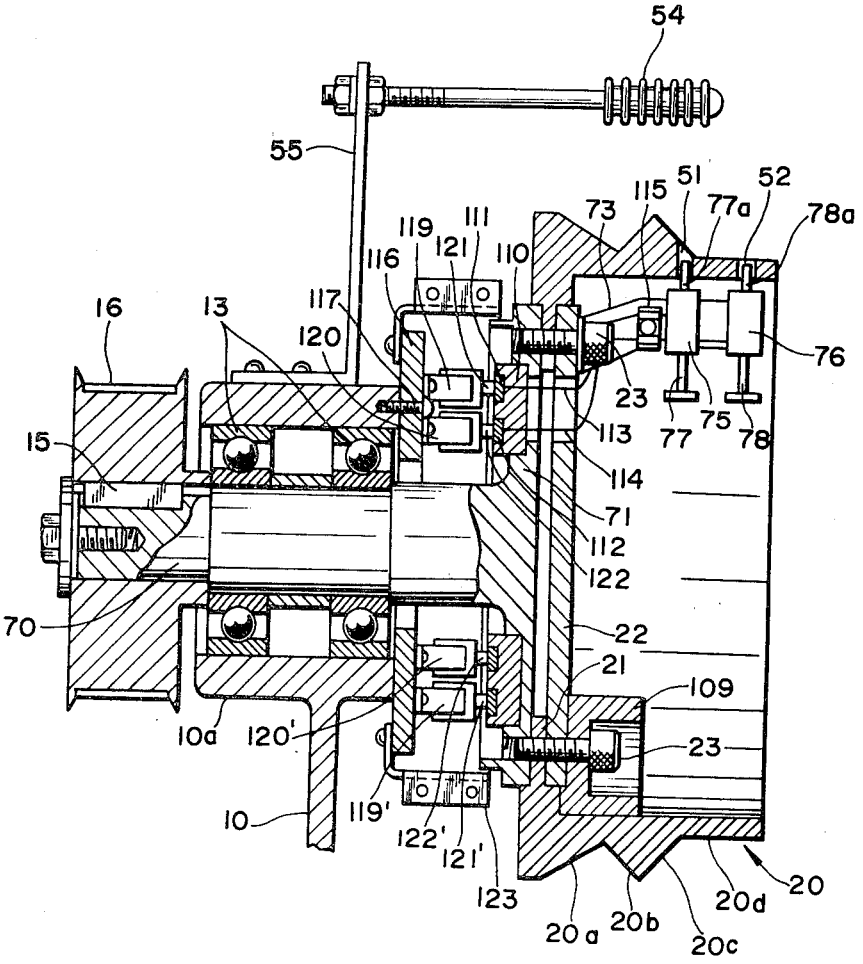
FIG. 26 is a sectional front view of a fourth embodiment of the weft detaining device in accordance with the present invention.
Figure 27:
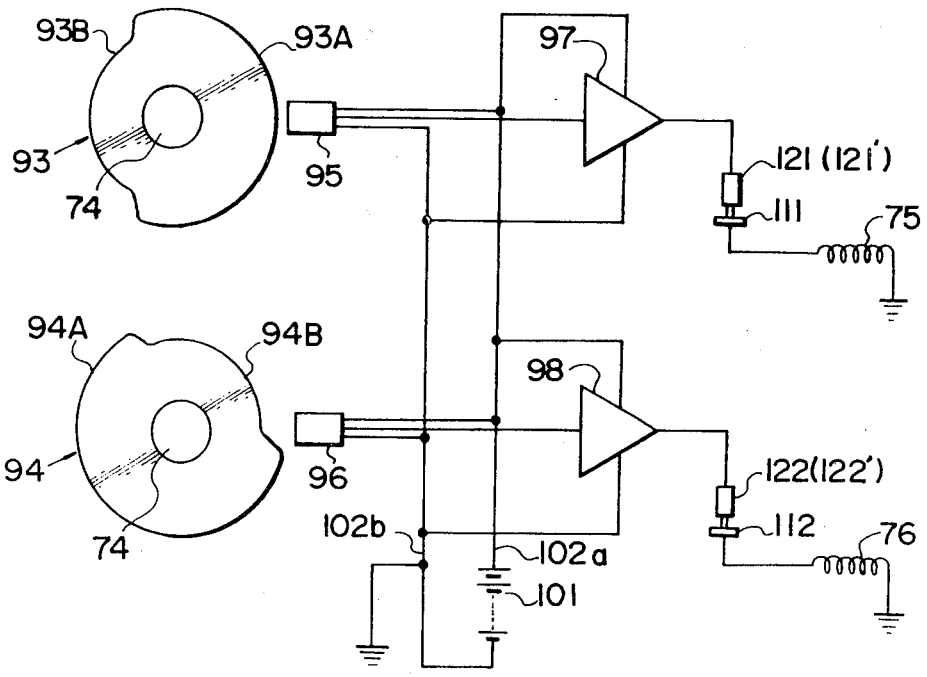
FIG. 27 is a schematic diagram of the device of FIG. 26.

FIGS. 26 and 27 illustrate a fourth embodiment of the weft detaining device in accordance with the present invention, which is a modification of the above-mentioned third embodiment. In this embodiment, the drum flange 21 is positioned between the base plate 22 and the shaft flange 71, and is retained thereon by bolts 23. The bolt 23 further fastens the support 73 onto the base plate 22. A counterweight 109 is fastened onto the base plate 22 by the bolt 23.

An annular support plate 110 formed of an insulating material is secured to the rear side surface of the flange 71. Two slip rings 111 and 112 are fixedly attached to the support plate 110 and are electrically connected through leads 113 and 114 to electromagnetic actuators 75 and 76. The leads 113 and 114 are secured in position by fixing member 115. Another annular support plate 116 is fixed onto an end face of the bracket bearing section 10*a*. The support plate 116 includes brush support members 119, 119', 120 and 120'. Brushes 121 and 121' are supported by the brush support members 119 and 119', respectively. Brushes 122 and 122' are supported by the brush support members 120 and 120'. The brushes 121 and 121' contact the slip ring 111, and the brushes 122 and 122' contact the slip ring 112. A protective cover 123 surrounds the vicinity of the brushes 122, 122' and the slip rings 111 and 112.

As shown in FIG. 27, the brushes 121, 121', 122 and 122' are supplied with electric currents from the amplifiers 97 and 98 upon receiving signals from the respective magnetic switches 95 and 96. With this arrangement, when respective magnetic switches 95 and 96 face the cam high lobe sections 93A and 94A, electric current is supplied from the amplifiers 97 and 98 through the brushes 121, 121' and the brushes 122, 122', respectively, to the slip rings 111 and 112, and to the electromagnetic actuators 75 and 76 to operate them.

Figure 28:
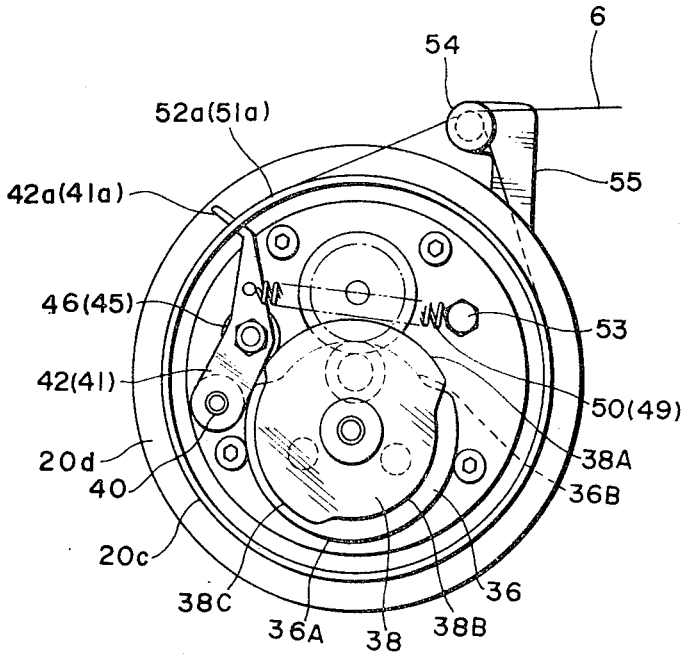
FIG. 28 is a right-side view similar to FIG. 4, showing the essential part of a fifth embodiment of the weft detaining device in accordance with the present invention.
Figure 29A:
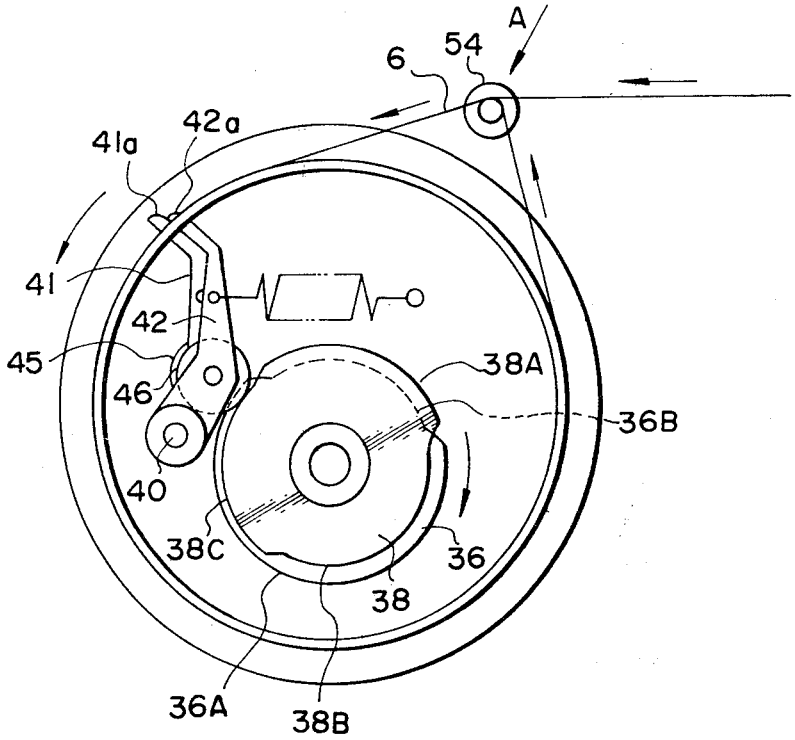
FIG. 29A is a view similar to FIG. 28, illustrating the operation of the device of FIG. 28.
Figure 29B:
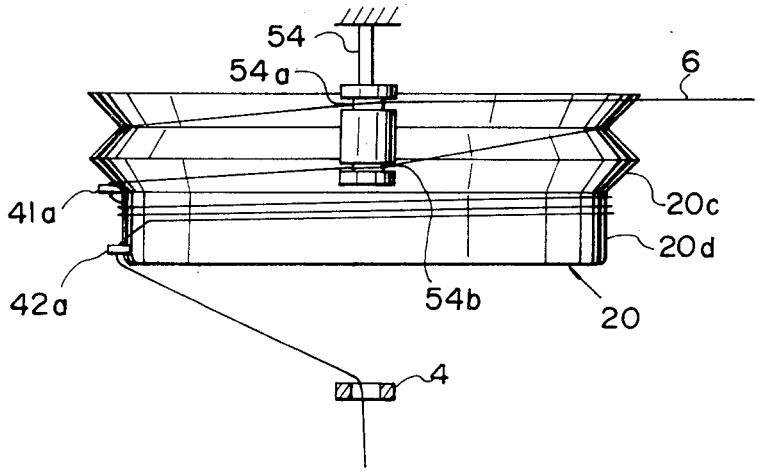
FIG. 29B is a view taken in the direction of arrow A of FIG. 29A.

FIGS. 28, 29A and 29B illustrate a fifth embodiment of the weft detaining device according to the present invention, which is similar to the first embodiment with the exception that the cam 38 is formed with a medium lobe section 38C in addition to the high and low lobe sections 38A and 38B. The cam 38 in this embodiment is arranged so that the medium lobe section 38C contacts the cam roller 46 during a beating up operation with a reed (not shown). When the cam roller 46 contacts the medium lobe section 38C, the hook lever section 42*a* is partially retracted into the drum 20, as shown in FIG. 29A.

The operation of this embodiment is as follows: During beating up the picked weft yarn against a cloth fell (not shown) with a reed, the weft yarn tension increases. However, the cam medium lobe section 38C contacts the second hook lever cam roller 46 to partially retract the hook section 42*a* into the drum 20. Since the hook lever 42 pivots about shaft 40, the partial retraction pivots the lever in the opposite direction of the drum rotation to relax the weft yarn tension to counter the effect of the increased tension in the beating up operation.

Figure 10:
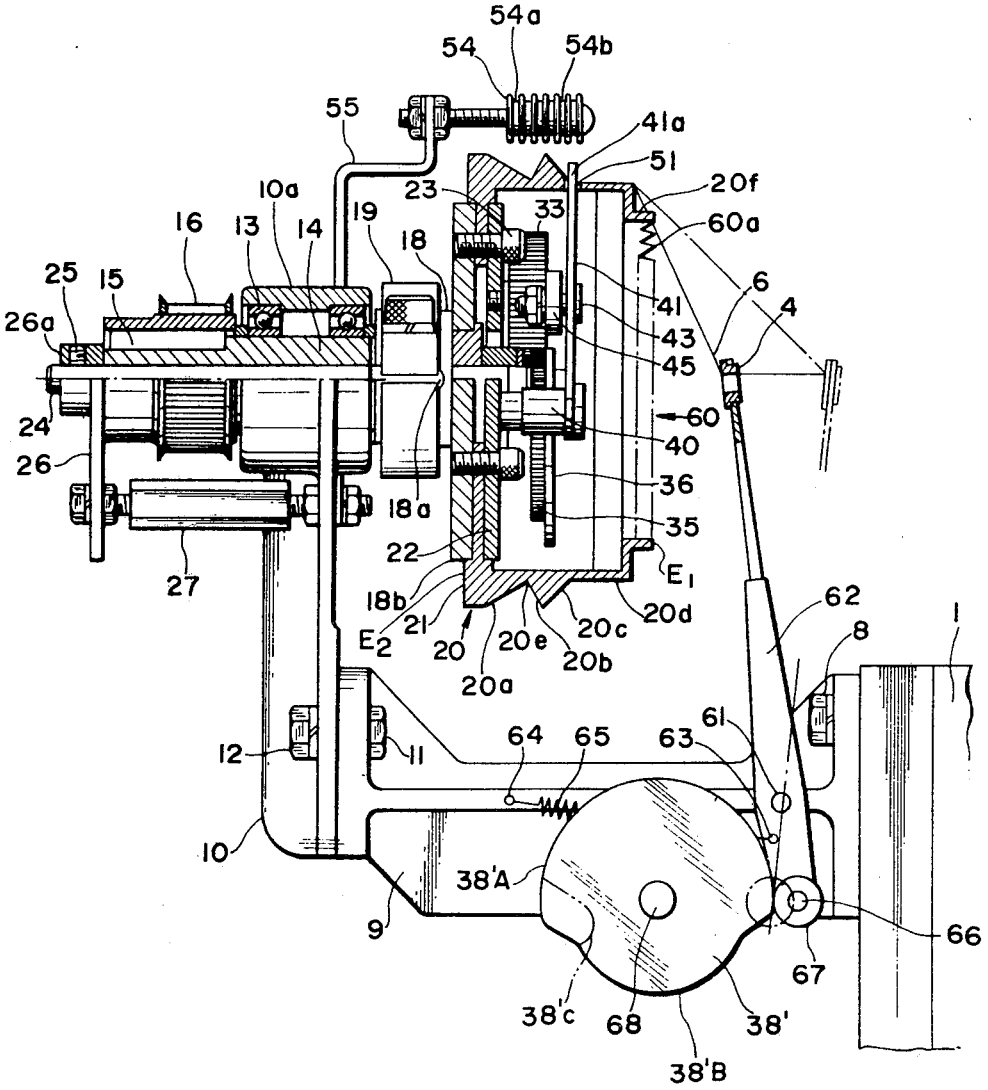
FIG. 10 is an elevational view, partly in section, of a second embodiment of the weft detaining device in accordance with the present invention.
Figure 11:
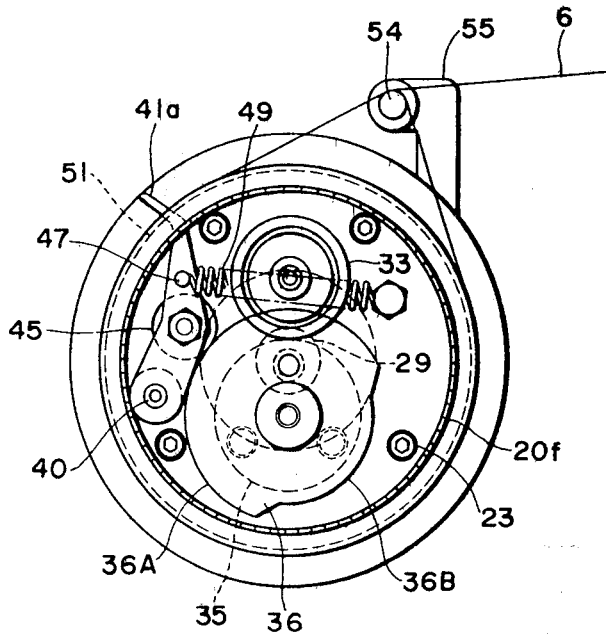
FIG. 11 is a right-side view of an essential part of the device of FIG. 10.
Figure 12A:
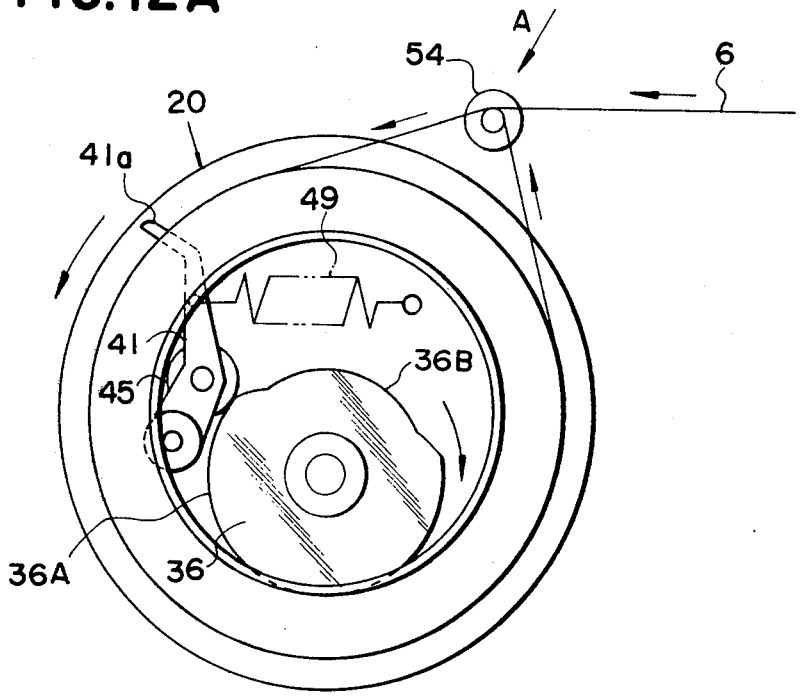
Figure 12B:
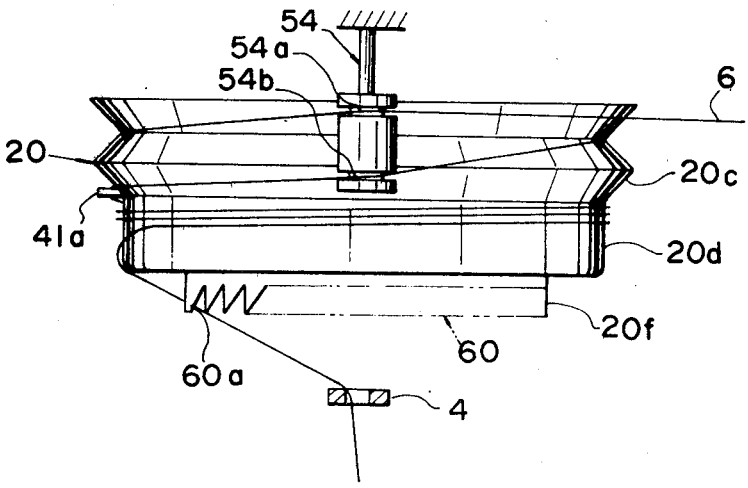

In this connection, with reference to the second embodiment shown in FIGS. 10 to 16B, it is preferable that the cam 38' be formed with a notch 38'C, as indicated in phantom in FIG. 10. With this arrangement, when the cam roller 67 contacts the notch 38'C, the lever 62 is rotated slightly further to shorten the length of weft yarn from the drum 20 to the air jet nozzle 2 to counter the effect of increased tension in the beating up operation.

While the drum 20 has been shown and described as formed with the first small diameter section $S_1$ larger than the diameter of the cylindrical section 20*d* in order to measure the length of the weft yarn required for each weft picking, it will be understood that the first frustoconical section 20*a* may be omitted and replaced with other weft yarn measuring means or a known weft yarn measuring device.

As is appreciated from the above description, according to the present invention, since the required amount of weft yarn for each pick is separately detained on a rotatable drum, the weft yarn tension does not abruptly change; therefore, the air pressure can be decreased and maintained constant. Further, during the air injection weft picking operation, the hooks are retracted into the drum 20 to reduce the weft advancing resistance generated by contact with the drum, so that weft shortpicks never occur. Furthermore, since the weft yarn is securely caught on the surface of the drum after completion of weft picking, it is unnecessary to add a device for restricting the weft yarn length required for one weft picking.

What is claimed is:

1. A shuttleless loom weft measuring and detaining device comprising:

a drum rotatable in synchronism with the operational cycle of the loom, on which drum a weft yarn is wound prior to introduction to a weft inserting nozzle, said drum being formed with a frustoconical section tapered toward the weft inserting nozzle, and a generally cylindrical section integral with said frustoconical section, said cylindrical section being located nearer to the weft inserting nozzle than is said frustoconical section, the weft yarn supplied from weft yarn supply means to said frustoconical section being introduced through said cylindrical section to the weft inserting nozzle;

first catching means for catching a first portion of the weft yarn to detain the weft yarn on said drum at least for a period of a weft picking of the weft yarn through the weft inserting nozzle, said first catching means including a first catching member located in the vicinity of the border between said frustoconical section and said cylindrical section to catch the weft yarn first portion; and second catching means for catching a second portion of the weft yarn to detain the weft yarn on said drum for a period except for at least the weft picking period, said second portion being located in front of said first portion relative to the direction of weft yarn movement, said second catching means including a second catching member associated with said cylindrical section to catch the weft yarn second portion, whereby a predetermined length of the weft yarn is wound on said cylindrical section between said first and second catching members prior to the weft picking.

2. A weft measuring and detaining device as claimed in claim 1, wherein said first catching member is formed with a first hook section which is projectable outside of the peripheral surface of said drum during the weft picking period.

3. A weft measuring and detaining device as claimed in claim 2, wherein said first catching means further includes a gear disposed within said drum, said gear revolving around the axis of said drum and revolving on its axis, in synchronism with the rotation of said drum, and a first cam secured onto said gear to operate said first catching member to project said first hook section from said drum with the rotation of said cam.

4. A weft measuring and detaining device as claimed in claim 3, wherein said second catching member is formed with a second hook section which is projectable outside of the peripheral surface of said drum for the period other than the weft picking period.

5. A weft measuring and detaining device as claimed in claim 4, wherein said first catching means includes a first electromagnetic actuator having a first movable rod forming said first catching member and formed with a first hook section which is projectable out of the peripheral surface of said drum during the weft picking period, and said second catching means includes a second electromagnetic actuator having a second movable rod forming said second catching member and formed with a second hook section which is projectable out of the peripheral surface of said drum, said first and second electromagnetic actuators being movable with the rotation of said drum.

6. A weft measuring and detaining device as claimed in claim 5, wherein said first catching means further includes first energizing means for energizing said first electromagnetic actuator to project said hook section during the weft picking period, and said second catching means includes second energizing means for energizing said second electromagnetic actuator for the period other than the weft picking period.

7. A weft measuring and detaining device as claimed in claim 6, wherein said first energizing means includes a first fixed annular magnetic coil connected to the frame of the loom, said first annular magnetic coil being energizable when supplied with electric current, and a first rotatable annular magnetic coil connected to said drum and located opposite said first fixed annular magnetic coil so that electric current is generated to energize said first electromagnetic actuator when said first fixed annular magnetic coil is energized, and wherein said second energizing means includes a second fixed annular magnetic coil connected to the frame of said loom, said second fixed annular coil being energizable when supplied with electric current, and a second rotatable annular coil connected to said drum and located opposite said second fixed annular magnetic coil so that electric current is generated to energize said second electromagnetic actuator when said second annular magnetic coil is energized.

8. A weft measuring and detaining device as claimed in claim 5, wherein said first energizing means includes a first electrically conductive brush connected to the frame of the loom, said first electrically conductive brush being suppliable with electric current, and a first rotatable slip ring supported by said drum and electrically connected to said first electromagnetic actuator, said first rotatable slip ring being in slidable contact with said first electrically conductive brush, and wherein said second energizing means includes a second electrically conductive brush connected to the frame of the loom, said second electrically conductive brush being suppliable with electric current, and a second rotatable slip ring supported by said drum and electrically connected to said second electromagnetic actuator, said second rotatable slip ring being in slidable contact with said second electrically conductive brush.

9. A weft measuring and detaining device as claimed in claim 4, wherein said second catching means further includes a second cam fixed on said first cam to operate said second catching device to project said second hook section from said drum.

10. A weft measuring and detaining device as claimed in claim 9, wherein said second catching means further includes means for moving the projected second hook section in the direction to loosen the weft yarn caught by the projected second hook section during the period of beating up the picked weft yarn.

11. A weft measuring and detaining device as claimed in claim 10, wherein said moving means includes a predetermined lobe section formed at the peripheral surface of said second cam, said second catching member being operated to move the projected hook section in the direction opposite the rotational direction of said drum, by said predetermined lobe section.

12. A weft measuring and detaining device as claimed in claim 11, wherein said moving means further includes a spring for biasing said second catching member in the direction opposite the rotational direction of said drum.

13. A weft measuring and detaining device as claimed in claim 3, wherein said second catching member includes a cylindrical saw-tooth section formed concentric with the end thereof, said cylindrical saw-tooth section being smaller in diameter than said cylindrical section, the second portion of the weft yarn being caught with said saw-tooth section for the period other than the weft picking period.

14. A weft measuring and detaining device as claimed in claim 13, wherein said second catching means includes a weft yarn guide movably disposed between said saw-tooth section and the weft inserting nozzle and reciprocally movable generally on the axis of the drum to guide the weft yarn to be capable of being caught by said saw-tooth section.

15. A weft measuring and detaining device as claimed in claim 14, wherein said second catching means further includes a cam rotatable in synchronism with the operation of said loom, and a lever having at its upper end said weft yarn guide, the lower end of said lever being movable by said cam.

16. A weft measuring and detaining device as claimed in claim 1, wherein said generally cylindrical section is slightly tapered toward the weft inserting nozzle.

17. A shuttleless loom weft measuring and detaining device comprising:

a drum on which a weft yarn is wound prior to introduction to a weft inserting means, said drum being formed with a taperered section which is tapered down toward the weft inserting means, and a generally cylindrical section which is integral with said tapered section, said generally cylindrical section being located nearer to the weft measuring means than is said tapered section, the weft yarn supplied from weft yarn supply means to said tapered section being introduced through said generally cylindrical section to the weft inserting means;

first catching means for catching a first portion of the weft yarn to detain the weft yarn on said drum at least for a period of a weft picking of the weft yarn through the weft inserting means, said first catching means including a first catching member located in the vicinity of the border between said tapered section and said generally cylindrical section to catch the weft yarn first portion; and second catching means for catching a second portion of the weft yarn to detain the weft yarn on said drum for a period except for at least the weft picking period, said second portion being located in front of said first portion relative to the direction of weft yarn movement, said second catching means including a second catching member associated with said generally cylindrical section to catch the weft yarn second portion, whereby a predetermined length of the weft yarn is wound on said generally cylindrical section between said first and second catching members prior to the weft picking.

18. A shuttleless loom weft measuring and detaining device comprising:

a drum on which a weft yarn is wound prior to introduction to a weft inserting means, said drum being formed with a frustoconical section tapered down toward the weft inserting means, and a cylindrical section integral with said frustoconical section, said cylindrical section being located nearer to the weft inserting means than is said frustoconical section, the weft yarn supplied from weft yarn supply means to said frustoconical section being introduced through said cylindrical section to the weft inserting means;

first catching means for catching a first portion of the weft yarn to detain the weft yarn on said drum at least for a period of weft picking of the weft yarn through the weft inserting means, said first catching means including a first catching member located in the vicinity of the border between the weft yarn first portion; and second catching means for catching a second portion of the weft yarn to detain the weft yarn on said drum for a period except for at least the weft picking period, said second portion being located in front of said first portion relative to the direction of weft yarn movement, said second catching means including a second catching member associated with said cylindrical section to catch the weft yarn second portion, whereby a predetermined length of the weft yarn is wound on said cylindrical section between said first and second catching members prior to the weft picking.

19. A shuttleless loom weft measuring and detaining device comprising:

a drum on which a weft yarn is wound prior to weft insertion by weft inserting means, said drum having an inclined section which is inclined down toward the weft inserting means, and a straight section connected to said inclined section, said straight section being located nearer to the weft inserting means than is said inclined section, the weft yarn supplied from weft yarn supply means to said inclined section being introduced through said straight section to the weft inserting means;

first catching means for catching a first portion of the weft yarn to detain the weft yarn on said drum inclined section at least for a period of weft picking of the weft yarn; and second catching means for catching a second portion of the weft yarn to detain the weft yarn on said drum straight section for a period except for at least the weft picking period, whereby a predetermined length of the weft yarn is wound on said drum by the cooperation of said first and second catching means.

* * * * *

UNITED STATES PATENT AND TRADEMARK OFFICE

CERTIFICATE OF CORRECTION

PATENT NO. : 4,381,807

DATED : May 3, 1983

INVENTOR(S) : H. Umezawa et al

It is certified that error appears in the above-identified patent and that said Letters Patent are hereby corrected as shown below:

Claim 18, Column 13, line 14, after "between", insert
--said frustoconical section and
said cylindrical section to catch--.

Signed and Sealed this

Ninth Day of August 1983

[SEAL]

*Attest:*

GERALD J. MOSSINGHOFF

*Attesting Officer*

*Commissioner of Patents and Trademarks*